US011541442B2

(12) United States Patent
Kern

(10) Patent No.: US 11,541,442 B2
(45) Date of Patent: Jan. 3, 2023

(54) PROCESSING MACHINE FOR FLAT MATERIAL PARTS WITH A SUPPORT UNIT AND METHOD THEREFOR

(71) Applicant: Thalmann Maschinenbau AG, Frauenfeld (CH)

(72) Inventor: Stefan Kern, Kirchberg (CH)

(73) Assignee: Thalmann Maschinenbau AG, Frauenfeld (CH)

( * ) Notice: Subject to any disclaimer, the term of this patent is extended or adjusted under 35 U.S.C. 154(b) by 123 days.

(21) Appl. No.: 16/992,768

(22) Filed: Aug. 13, 2020

(65) Prior Publication Data

US 2021/0046533 A1 Feb. 18, 2021

(30) Foreign Application Priority Data

Aug. 15, 2019 (EP) ..... 19191932

(51) Int. Cl.
*B21D 5/04* (2006.01)

(52) U.S. Cl.
CPC ..... *B21D 5/042* (2013.01)

(58) Field of Classification Search
CPC ..... B21D 5/042
USPC ..... 72/316; 414/427
See application file for complete search history.

(56) References Cited

U.S. PATENT DOCUMENTS

2016/0107847 A1 4/2016 Grunewald et al.
2017/0252794 A1* 9/2017 Kern ..... B21D 43/003
2020/0188979 A1* 6/2020 Dal Cerro ..... B21D 43/105

FOREIGN PATENT DOCUMENTS

EP 3208008 A1 8/2017
EP 3403738 A1 11/2018
WO 9316822 A1 9/1993
WO 9732677 A1 9/1997

OTHER PUBLICATIONS

Variobend By ASCO Machines YouTube.com "www.youtube.com/watch?v=VtqX869N3Tk" (Year: 2015).*
ASCO Machines, "Variobend—Wendervorrichtung / Variobend—Automated flipping device—dispositivo di rotazione", YouTube, Feb. 2, 2015, https://www.youtube.com/watch?v=Eg3Ovmc_wZQ.
(Continued)

*Primary Examiner* — Jessica Cahill
*Assistant Examiner* — Smith Oberto Bapthelus
(74) *Attorney, Agent, or Firm* — The Webb Law Firm

(57) ABSTRACT

A processing machine for flat material parts includes a machine frame, a lower beam, an upper beam, at least one processing tool, and a control unit and an infeed table on which the flat material part to be processed can be placed for positioning in the processing machine. A support loading unit with a plurality of suction cups is provided for the positioning of the flat material part on the infeed table. The infeed table can be moved from a parking position in an extension direction to a loading and unloading position and back again. The support unit is mounted on the movement axis assigned to the processing tool or tools for a pivoting movement into the same direction.

6 Claims, 22 Drawing Sheets

(56) References Cited

OTHER PUBLICATIONS

ASCO Machines, "Variobend Wendevorrichtung—Flipping Device—dispositivo di rotazione—Automatyczny obrót detalu", YouTube, Feb. 23, 2015, https://www.youtube.com/watch?v=VtqX869N3Tk.
Jornsswiss: "Jorns longfolder (integrated in manufacturing line)", May 14, 2009, XP055878540, Found in Internet: URL: https://www.youtube.com/watch?v=WwuX11 ckxmM&ab_channel=jornsswiss.

* cited by examiner

IG. 17

PROCESSING MACHINE FOR FLAT MATERIAL PARTS WITH A SUPPORT UNIT AND METHOD THEREFOR

CROSS-REFERENCE TO RELATED APPLICATION

This claims priority to European Patent Application No. 19 191 932.3 filed Aug. 15, 2019, the disclosures of which are hereby incorporated by reference in their entirety.

BACKGROUND OF THE INVENTION

Technical Field

The present invention relates to a processing machine for flat material parts comprising a machine frame, a lower beam, an upper beam, at least one processing tool associated with the lower beam or upper beam and held on the machine frame, a controller for controlling a processing sequence with the processing tools, a feed table on which the flat material part to be processed can be placed for positioning in the processing machine, and a support unit for the predetermined positioning of the flat material part on the feed table, wherein the feed table is movable from a parking position in an extension direction to a loading and unloading position and back again, and wherein the support unit has a plurality of suction cup with which the flat material part can be picked up and positioned by the feed table.

Technical Considerations

A processing machine for flat material parts with a support unit is known from the applicant's EP 3 208 008 A1. This support unit allows to improve the feeding process of the placed flat material part, in particular to accelerate it.

A processing machine for flat material parts from ASCO with a placement unit is known from https://www.youtube-.com/watch?v=Eg3Ovmc_wZQ (dated 2 Feb. 2015) as shown at a fair. The support unit is here a turning unit, in which a group of suction cups are each arranged between individual sections of the divided infeed table and rotate the workpiece about an axis parallel to the bending axis, which bending axis is swung out from below the infeed table above the infeed table, whereby the suction cups are attached to arms arranged transversely to the bending axis. The arms are of a predetermined length so that they can grip and turn over the flat material part from behind it. The beams of the processing machine must be moved far apart in order to achieve a sufficient height of the open beams so that flat material parts of a certain width can also be turned over. Turning in the machine also accelerates the feeding or feeding process, as the next bending step can be started more quickly. A further video at https://www.youtube.com/watch?v=VtqX869N3Tk shows a company video of a processing machine for flat material parts with the above mentioned function.

US 2016/107847 A1 shows a handling device for a folding machine. The part to be bent can be gripped on one of its flat sides by pulling forces acting on one side of the flat side at several points in succession in the longitudinal direction, after which the holding unit can in turn be swivelled relative to a swivelling carrier unit about a first swivel axis parallel to the longitudinal direction, wherein the pivotable support unit is pivotable relative to a pivotable support base about a second pivot axis which is parallel to the first pivot axis, and wherein the pivotable support base is movable in a direction transverse to the second pivot axis by means of a support base movement unit.

WO 97/32677 A1 shows an apparatus for bending a metal sheet comprising a frame, a stationary lower beam having a lower clamp, a movable upper beam having an upper clamp, said clamps each having a clamping surface for clamping a metal sheet in a working position, a lower bending beam and an upper bending beam for bending a clamped metal sheet upward and downward, respectively. downward, the bending beams each being rotatably supported on both sides about a respective axis in a support plate, the support plates being movably mounted in the frame such that the lower or upper bending beam can be moved to a working position in which its axis lies substantially in the plane of the clamping surface of the lower or upper clamp, respectively. A device is also provided for holding the sheet metal, the holding device being provided with a substantially C-shaped frame with a carriage which is movable on a carriage bed to and fro between a front and a rear position, the legs of the C-shaped frame each carrying a lower and an upper disc suitable for engagement with a sheet metal in a working position. In the forward position of the sled, the legs of the C-shaped frame extend between the upper and lower beams such that the lower and upper discs are adjacent to the clamps.

WO 93/16822 A1 is related to a bending press which has bending devices with bending bars and gripping devices mounted on a fixed lower jaw and a movable upper jaw. For the execution of the bending movement, the bending devices are attached to the jaws by means of spatial mechanisms, preferably ball joint couplings, and are brought into position longitudinally by means of mechanically or hydraulically operated shifting devices.

SUMMARY OF THE INVENTION

Based on this prior art, it is an object of the present invention to indicate a processing machine in which the feeding or unloading process can be accelerated, whereby this may include a machine-internal feeding as a turning process. Advantageously, the functions are integrated and also allow the output of a directly turned machined flat material part.

A processing machine for flat material parts comprises a machine frame, a lower beam, an upper beam, at least one processing tool, an infeed table on which the flat material part to be processed can be placed for positioning in the processing machine, a support unit for predetermined positioning of the flat material part on the infeed table, and a control unit for controlling a processing sequence with the processing tools and the movement of the placement unit and the movement of the infeed table, wherein the infeed table can be moved in an extension direction from a parked position to a second position and back again, and wherein the support unit has a plurality of suction cups with which the flat material part can be received and positioned, wherein the support unit is mounted on the axis of movement associated with the processing tool or tools for a pivoting movement in the same direction.

The fact that the support unit is mounted on the movement axis assigned to the processing tool(s) outside the assigned beam for a similar swivel movement results in several advantages. On the one hand, an existing movement axis is used for this support unit, which works as a swivel unit, so that no further elements are necessary. Furthermore, the feature "outside" of an assigned beam means that the mechanics, for example a parallelogram mechanics for the movement of the processing beam is arranged on the side of the beams opposite the swivel axis of the upper and lower part, so that this mechanics does not require a large opening of the upper part for the turning process. In all FIGS. 2 to 12, the double arrow with reference numeral 17 indicates the direction of movement of the flat material part out of the inner space. The double arrow is apparently "inside" the inner space of the machine formed by the upper and lower parts in cross-sectional view, while said turning unit is mounted on the movement axis associated with said working tools for a similar pivoting movement, i.e. for a pivoting movement in the same direction, "outside" the upper and lower parts in cross-sectional view.

This makes it possible to turn even wide sheets, since the width of the flat material part or sheet may correspond to the free space between the plane of the infeed table and the frame of the processing machine on the one hand downwards or the room height starting from the plane of the infeed table upwards on the other hand. At the same time, this procedure speeds up the manipulation of the sheets, as the clamping beams only need to be opened slightly, namely only to the extent that the folded ends of the sheet rise above the middle level, i.e. no more than is necessary to push out such a processed sheet through the feed table itself.

It is advantageous that the suction cups of the feeding or support unit are directly connected to the motion control, for example a parallelogram mechanism, of the processing tools, so that only a corresponding drive via the sections of the processing machine has to be provided. The suction cups can be mounted in a row on a frame. It is also possible to provide two rows of suction cups.

In the parking position of the suction cups, the plane of the suction cups forms an acute angle with the horizontal plane of the feed table, in particular an angle between 70 and 85 degrees. In addition, it is advantageous to extend the feed table between the lower beam and the upper beam in order to pick up a turned flat material part after loosening the suction cups.

This makes it possible for a support unit belonging to the upper beam to slide down the flat material part turned through 95 to 110 degrees onto either the feed table or a support provided below by loosening the suction cups.

For a support unit belonging to the lower beam, the flat material part turned through 95 to 110 degrees can also slide down onto a support provided below by loosening the suction cups.

A further feeding can be realized by the placement unit at the upper or lower processing tool, if the flat material part is placed on the suction cups which are then activated in the parking position of the upper or lower beam and the flat material part placed in this way is deposited on the outgoing feed table by swivelling downwards or upwards, so that processing by the bending tools begins, especially after the feed table has returned and the flat material part has been aligned.

A further processing machine for flat material parts comprises a machine frame, a lower beam, an upper beam, at least one processing tool, an infeed table on which the flat material part to be processed can be placed for positioning in the processing machine, a placement unit for predetermined positioning of the flat material part on the infeed table, and a control unit for controlling a processing sequence with the processing tools and the movement of the placement unit and the movement of the infeed table, wherein the infeed table can be moved in an extension direction from a parked position to a second position and back again, and wherein the placement unit has a plurality of suction cups with which the flat material part can be received and positioned, wherein the placement unit is connected transversely to the processing tool or tools within the associated beam for a feed movement of the flat material part in the direction of the processing edge of the flat material part.

Because the placement unit is connected transversely to the processing tool or tools laterally within the associated beam for a feeding movement of the flat material part in the direction of the processing edge of the flat material part or component, a loading movement can be effected via a rail which is pivotally connected to the upper part, thus enabling the flat material part to be lifted off a loading table. The purpose of the placement unit here is to ensure that the flat component is fed in the direction of the processing edge of the flat component. For this purpose, the placement unit can be moved transversely to the processing tool(s), i.e. parallel to the processing edges of the processing tool(s), within the assigned beam while being connected to this beam. This enables the feeding movement of a flat material part in the direction of the processing edge of the flat material part, which enables the loading of the device directly after ejection of a processed flat component to the front of the machine.

It is advantageous that the loading or transfer table is arranged in a parallel plane and higher than the plane defined by the infeed table, so that the transfer of the flat material part is possible without additional swivelling movement of the loading unit.

It is advantageous that a free space is provided between the transfer table and the infeed table as parking space for the loading unit, so that the processing machine can carry out the clamping movement of the beams necessary for the folding movement of a flat material part without this loading unit spatially obstructing such a movement.

It is advantageous to use both support/turning/placement units in combination, so that one person can feed flat material parts to the machine and turn them (or not) and remove them alone after processing is completed from the machine.

Technically, the support units/placement units described herein have in common that they feed the flat material part into the interior from the outside without having to open the clamping beams very wide, which opening action takes a certain amount of time with processing machines. In addition, the complexity of the machines is kept low by attaching the corresponding holding devices, suction cups to frames which are attached to existing swivel axes of the machine, so that the costs are kept low. It is an advantage that a processing machine can comprise the support unit or the upper and lower support and turning units as described as well as the placement unit at the same time improving the feeding in of a material part with the placement unit and the re-loading and turning of a (partially machined) material part.

BRIEF DESCRIPTION OF THE DRAWINGS

Preferred embodiments of the invention are described in the following on the basis of the drawings, which are for explanatory purposes only and are not to be interpreted restrictively. The drawings show:

FIG. 16 shows a perspective view of the situation of FIG. 15 with the support unit moving in;

DESCRIPTION OF PREFERRED EMBODIMENTS

Figure 1:
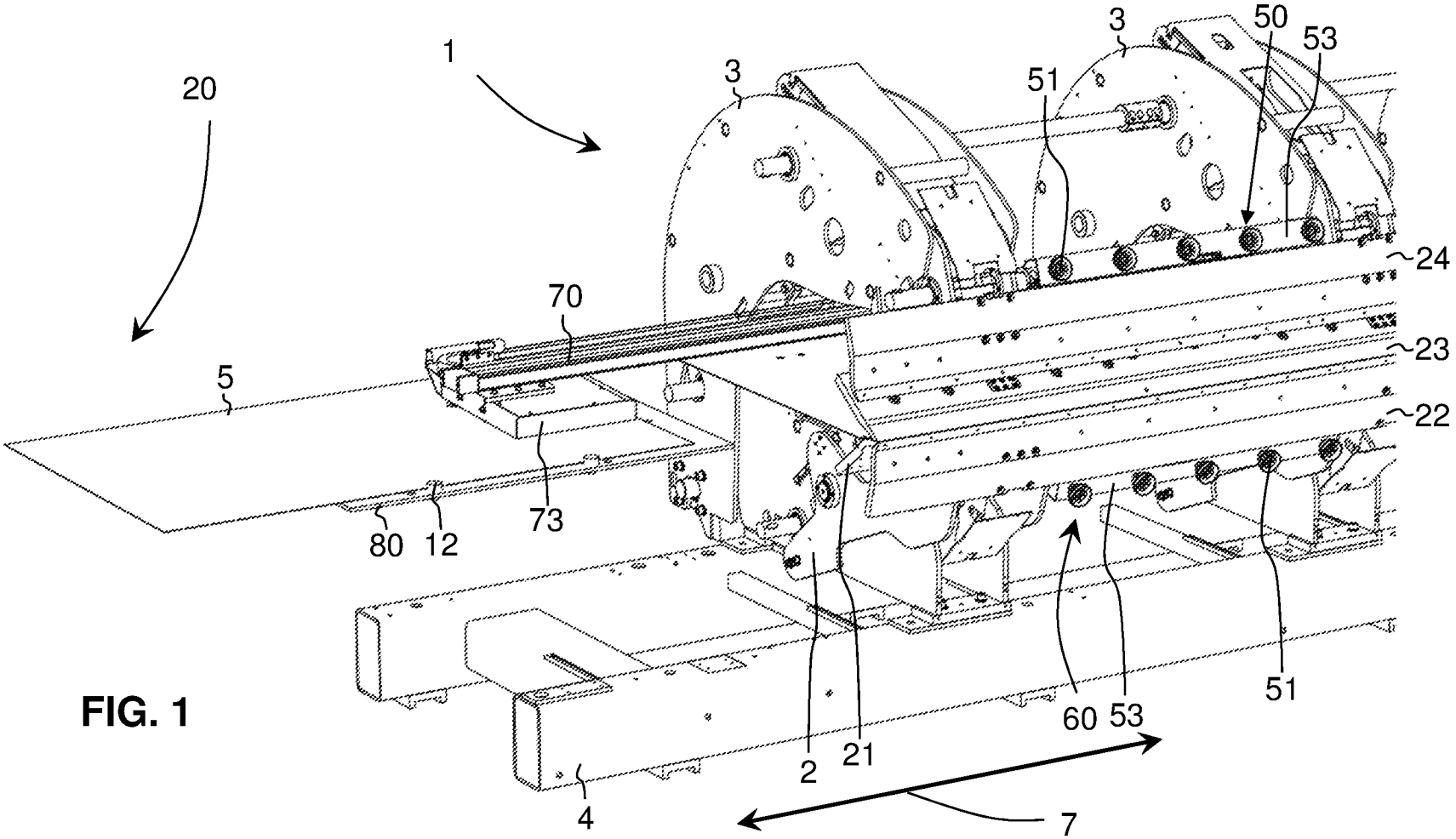
FIG. 1 shows a perspective view of a processing machine according to examples of the invention.

FIG. 1 shows a perspective view of a processing machine 1 according to embodiments of the invention. More precisely, of two sections of a processing machine 1 with its upper machine frame parts 3 and lower machine frame parts 2, which are arranged on a transverse frame 4. Usually processing machines 1 are equipped with four, six or eight sections, in which an upper turning unit 50 is particularly advantageous due to the length and weight of the flat material part 5 to be turned. The frame 4 runs in one direction of the double arrow 7, which direction is also the direction of the bending edges that can be produced with processing machine 1. This direction is transverse to the feed direction 17.

The section shown in FIG. 1 furthest to the left is the foremost section in front of a set-up area 20. Here a lay-on unit is shown in the form of a side insertion unit 70, which is explained in connection with FIG. 13 to FIG. 22. This side insertion unit 70 is used together with a transfer table 80 with stops 12.

The upper part 3 is also referred to as the upper machine frame part and the lower part 2 as the lower machine frame part of such a sheet bending machine. These are arranged perpendicular to a feeding direction 17 of a work part 5 to be bent and are movable against each other. A lower holding beam 21 and a lower bending beam, also referred to as lower processing tool 22, are assigned to the lower machine part, and an upper holding beam 23 and an upper bending beam, also referred to as upper processing tool 24, are assigned to the upper machine part, the four beams being aligned transversely to said feed direction and the flat part 5 to be bent being insertable between said four beams between the machine parts, wherein the upper holding beam clamps the workpiece to be bent in a clamping position opposite the lower holding beam, the lower bending beam being arranged in said clamping position to bend the flat material part 5 to be bent upwards around the front edge of the upper holding beam, wherein in the case of a double bender a further clamping position is arranged in such a way that the upper bending beam 24 can bend the flat material part 5 to be bent downwards around the front edge of the lower holding beam 21.

The upper parts 3 and lower parts 2 can be driven and hinged in a variety of ways, in particular according to the applicant's EP 3 403 738 A1. Nor does processing machine 1 need to be a double bending unit with a lower processing tool 22 and an upper processing tool 24, as shown here in FIG. 1. It may also be a single processing tool, in which case it is assigned to the upper turning unit 50 as a support unit. FIGS. 2 to 12 show here a double bender with two support units provided as an upper turning unit 50 and a lower turning unit 60, which are assigned to the two processing tools 22 and 24.

The upper turning unit 50 comprises a series of suction cups 51 connected to a pneumatically operated vacuum source, whereby this connection is controlled, for example, by hydraulically activated valves. The upper turning unit 50 or the suction cups 51 of this unit are attached to a frame component 53, to which the processing tool 24 is directly or indirectly attached. The processing tool 24 is linked to the upper part 3 and the upper beam 23 via a movable parallelogram mechanism 52 shown in FIG. 4. In particular—as in the case of EP 3 403 738 A1—the machining tool 24 is already arranged opposite the upper part 3 and the upper beam 23 in such a way that the machining tip of the machining tool 24 is arranged in the direction of extension of the infeed table 10, which corresponds to the direction of the plane defined by the surface of the underside of the suction cups 51, which direction is defined by the sheet 5 in the side view of FIG. 6.

Figure 6:
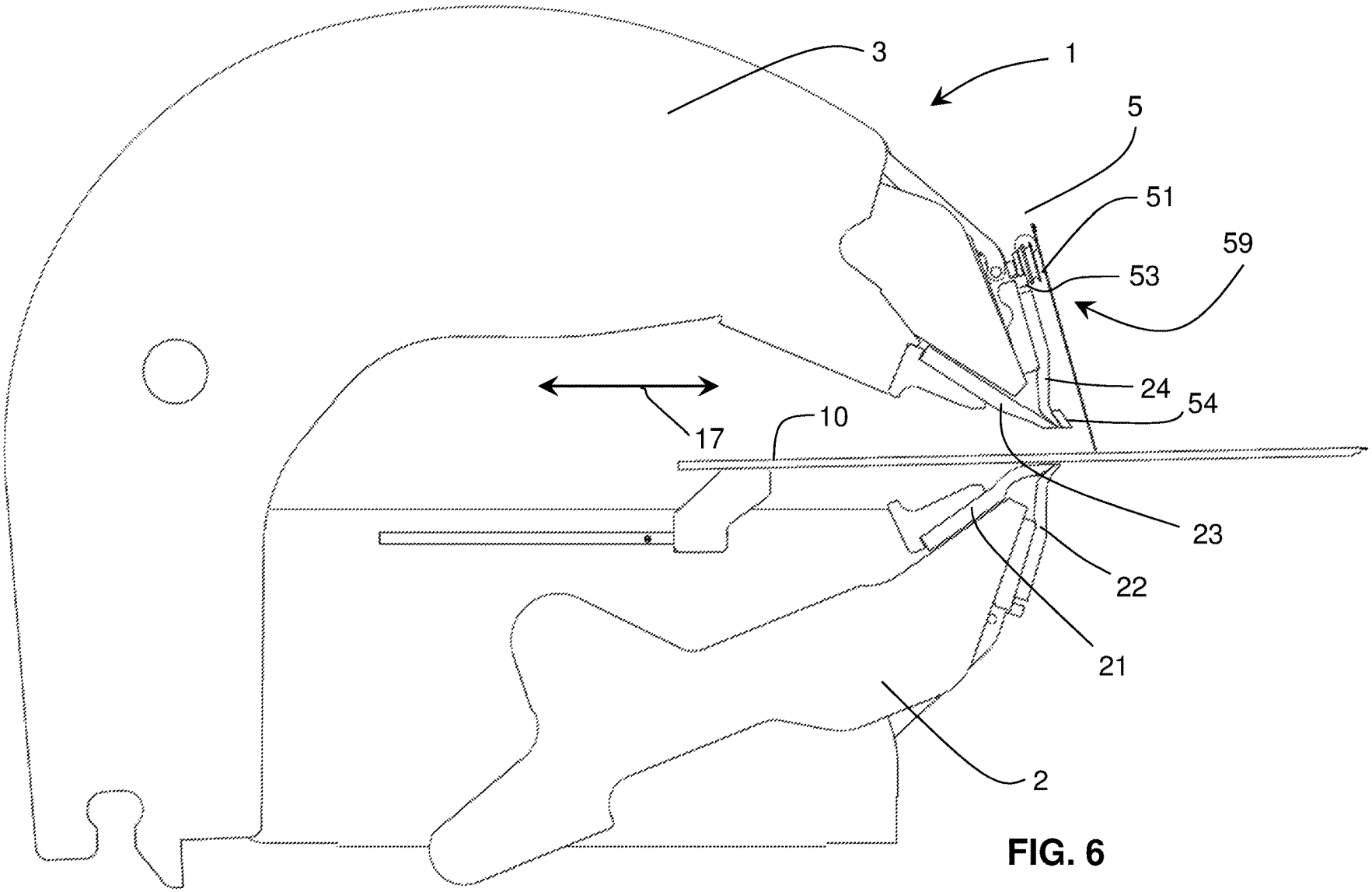
FIG. 6 shows a schematic side view of the processing machine according to FIG. 1 with a pushed out infeed table and the feeding unit with the flat material part lowered onto the infeed table.
Figure 7:
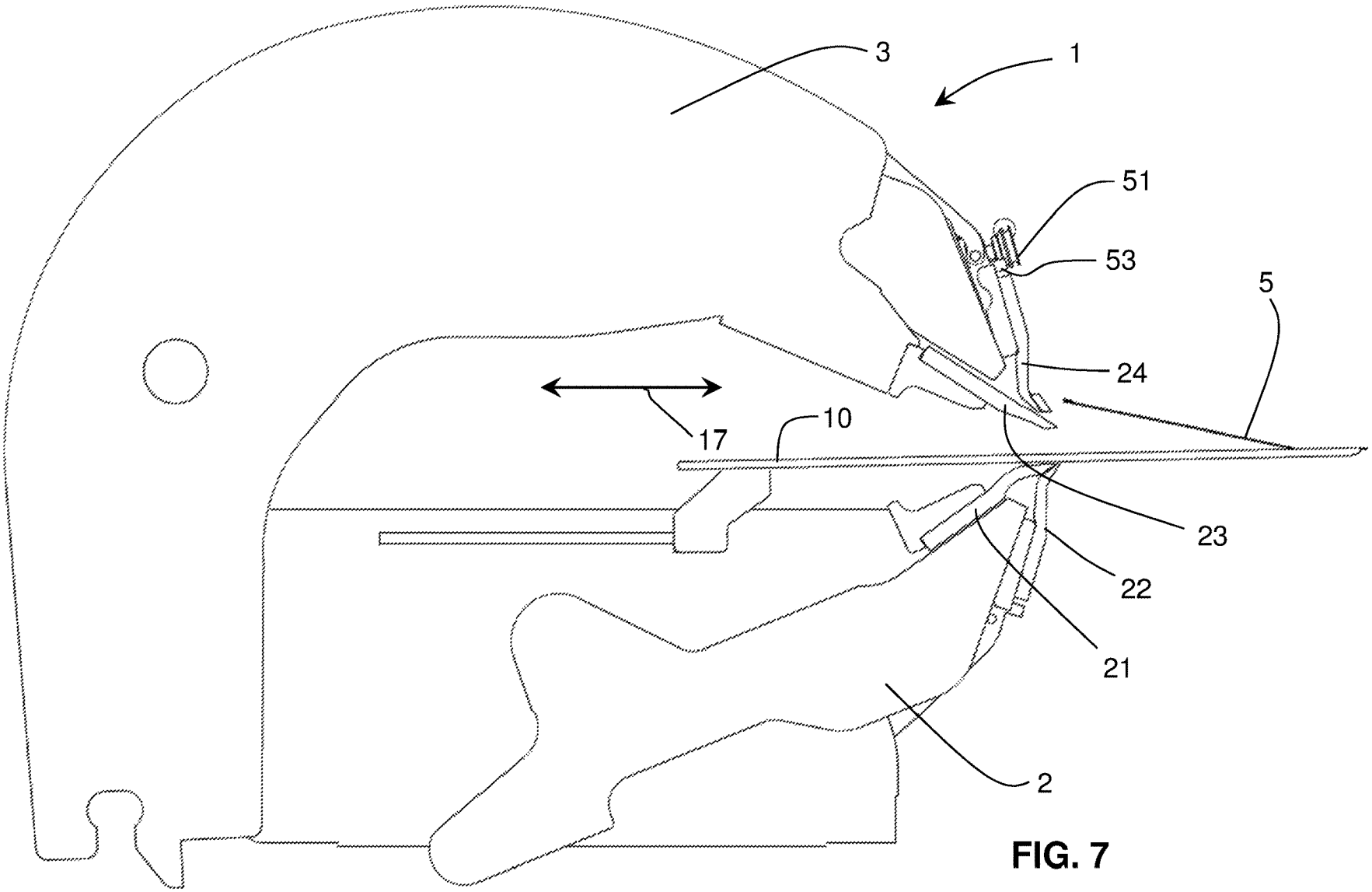
FIG. 7 shows a schematic side view of the processing machine according to FIG. 1 with a pushed out infeed table and the feeding unit with a released flat material part sliding on the infeed table.

FIG. 6 shows the upper turning unit 50 after the flat material part 5 has been placed on the machine, before it is placed on the feed table 10 as shown in FIG. 7 and is then fed into the machine 1 as a feeding step by retracting the feed table 10 in order to be advanced in the direction of 17 predetermined for machining after it has stopped at the depth stops between sections of the feed table.

Figure 2:
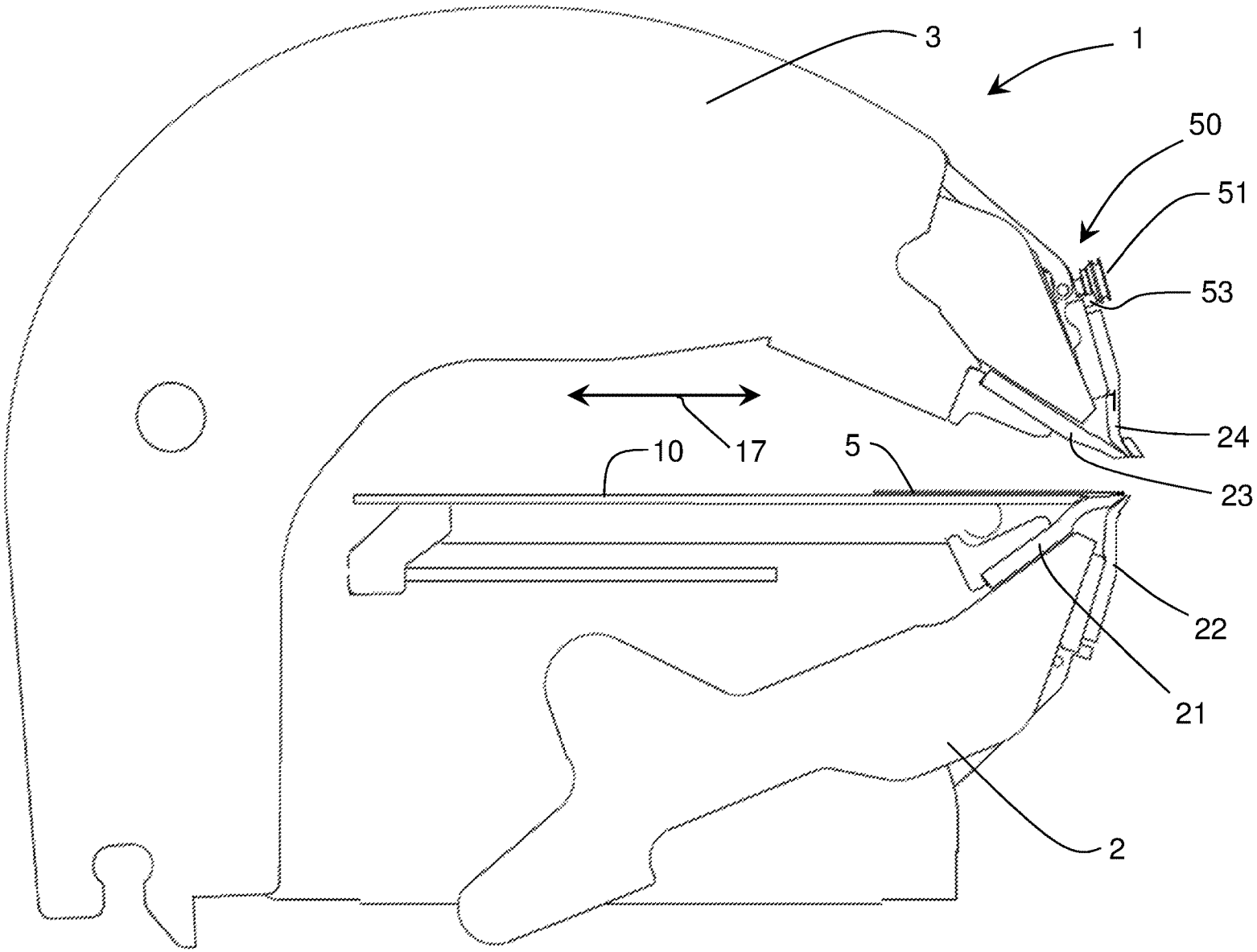
FIG. 2 shows a schematic side view of the essential parts of a processing machine according to FIG. 1 with an infeed table and the feeding unit in a rest position.

FIG. 2 to FIG. 8 show in a sequence the sequence of movements when using this feeding or support unit with its further function as upper turning unit 50. FIG. 2 shows a schematic side view of the main parts of a processing machine 1 with an infeed table 10 and the upper turning unit 50 in a rest position. The upper part 3 is slightly opened opposite the lower part 2.

Figure 3:
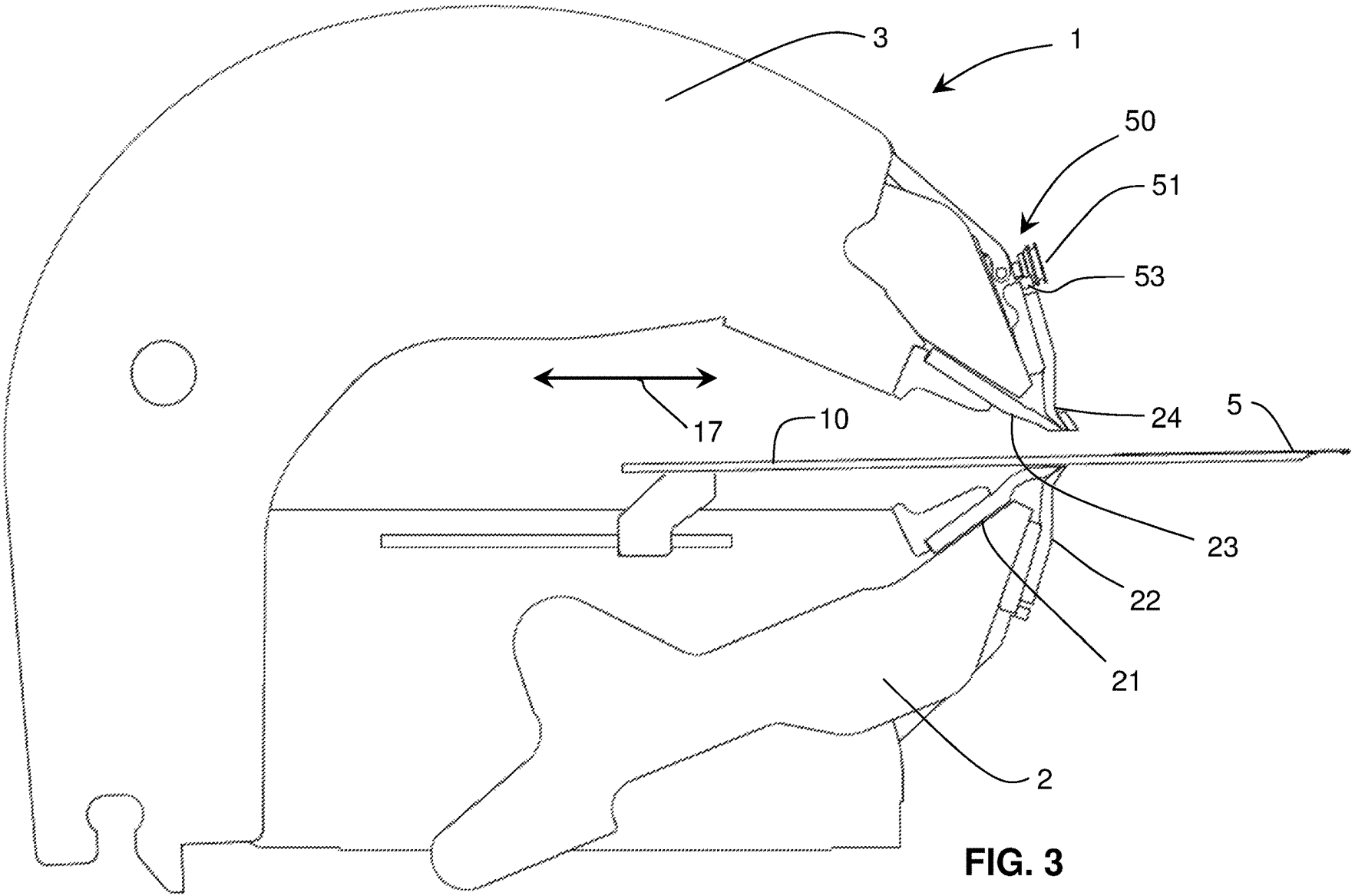
FIG. 3 shows a schematic side view of the processing machine according to FIG. 1 with a pushed out infeed table and the feeding unit in a rest position.

FIG. 3 shows a schematic side view of the processing machine 1 according to FIG. 1 with a pushed out infeed table 10 on which the sheet metal 5 to be processed or already processed lies. The upper turning unit 50 is in a rest position.

Figure 4:
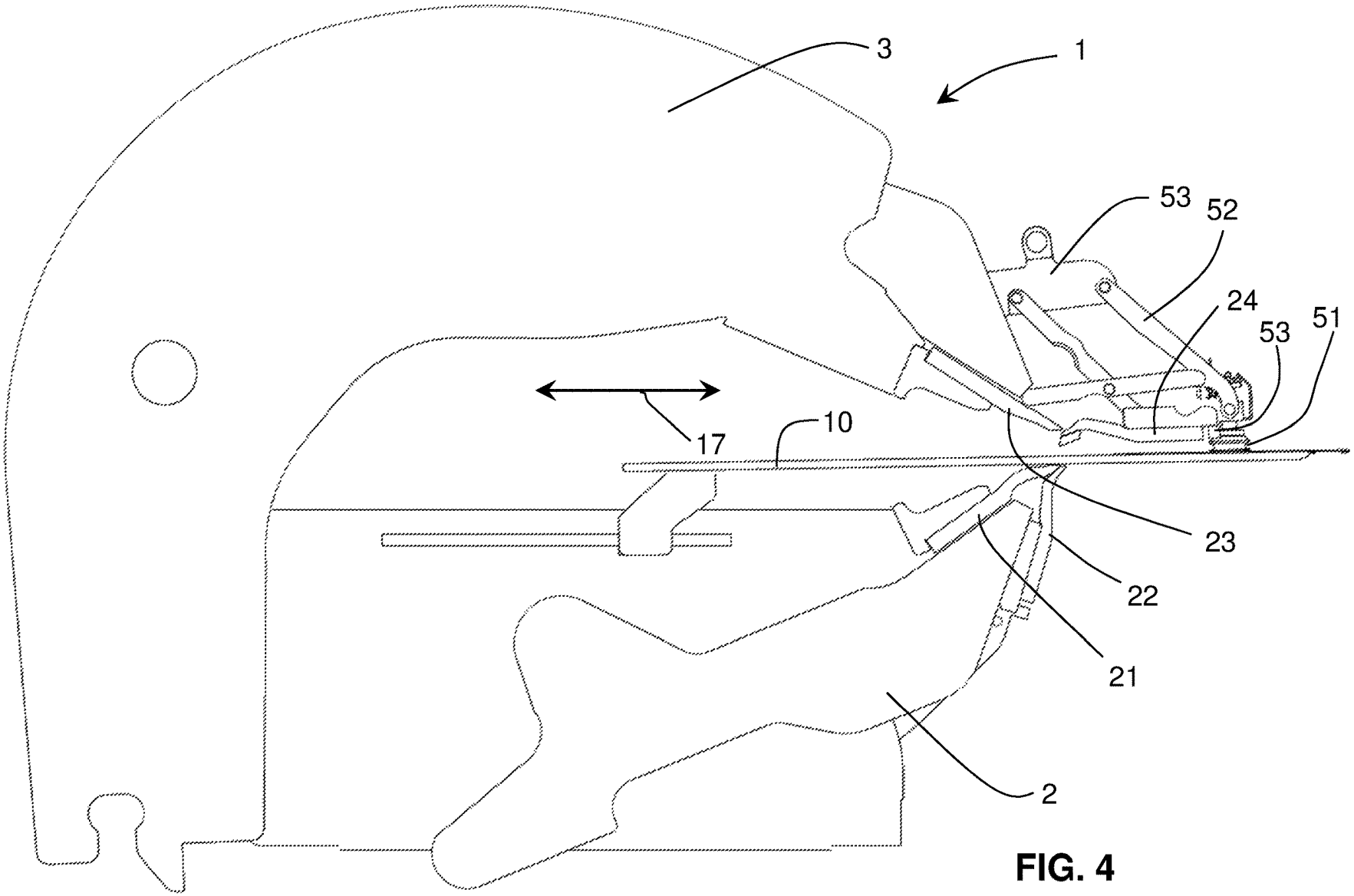
FIG. 4 shows a schematic side view of the processing machine according to FIG. 1 with a pushed out infeed table and the feeding unit on the flat material part in a receiving position.

FIG. 4 shows a schematic side view of the processing machine 1 according to FIG. 1 with a pushed out infeed table 10 and the upper turning unit 50 on the flat material part 5 in a pick-up position. The upper processing tool 24 is swivelled as for a folding operation, except that the upper part 3 of processing machine 1 is slightly open in relation to the lower part. This opening only needs to be slightly open so that the processing tip of the upper processing tool 24 remains surely above the infeed table 10. In the embodiment shown, the machining tool 24 with the parallelogram mechanism 52 is swivelled on the holder 53 outside the upper part 3 so that the suction cup 51 shown (from a row of suction cups 51 arranged parallel to the machining tool 24 in direction 7) is lowered onto the flat material part 5 and supported on it so that the flat material part 5 adheres to the suction cups 51 by means of a downstream suction of air located inside the suction cup 51. Normally a vacuum is generated pneumatically and applied to the suction cups 51 via hydraulically operated valves, which vacuum is then constantly maintained.

Figure 5:
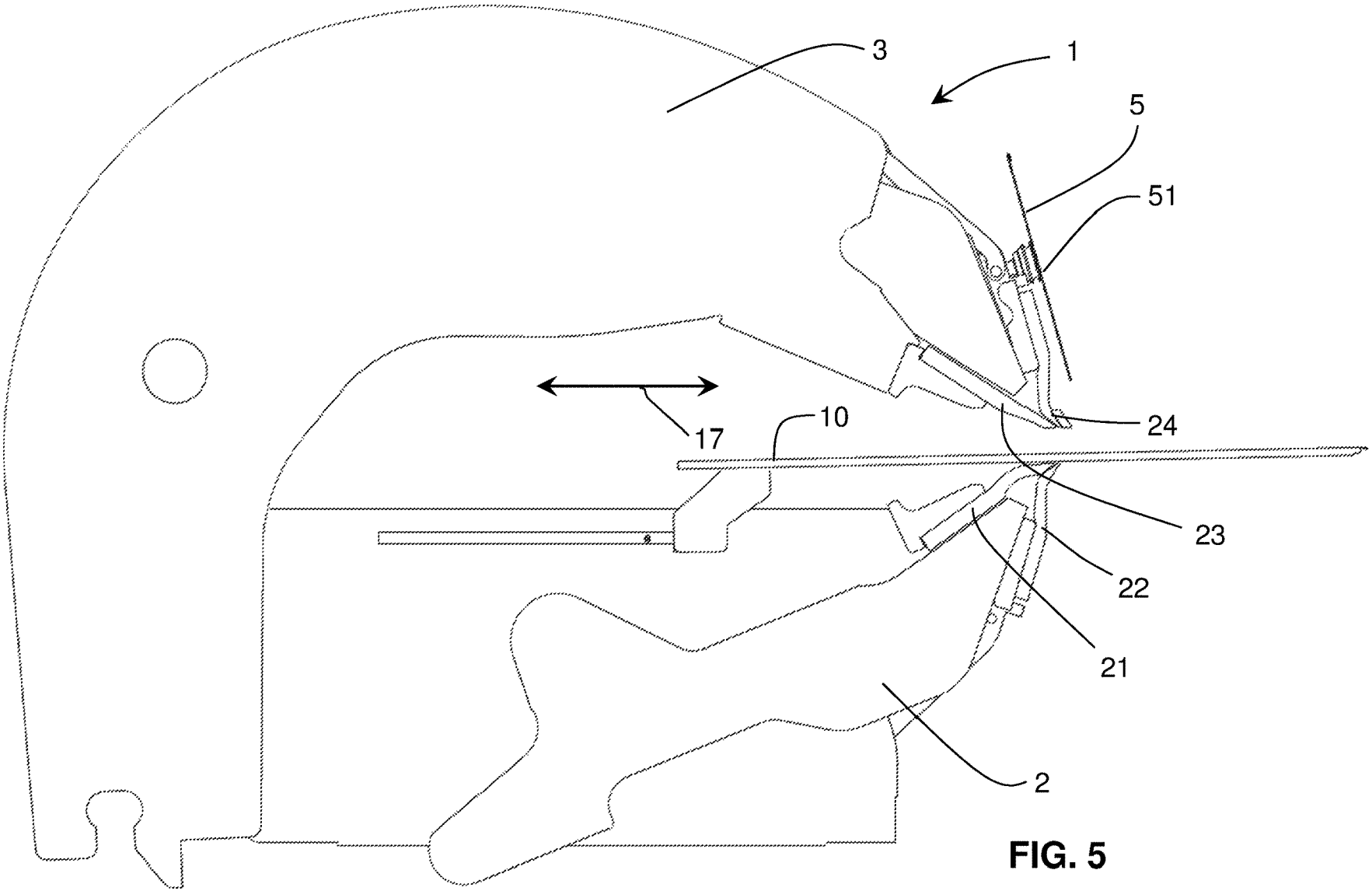
FIG. 5 shows a schematic side view of the processing machine according to FIG. 1 with a pushed out infeed table and the feeding unit with the picked up flat material part back in a rest position.

FIG. 5 shows a schematic side view of the processing machine 1 according to FIG. 1 with a pushed out feed table 10 and the upper turning unit 50 with picked up flat material part 5, whereby the upper turning unit 50 goes back into the rest position. This position of FIG. 5 is achieved by returning the processing tool 24 to its starting position while maintaining the vacuum from FIG. 4.

FIG. 6 shows a schematic side view of the processing machine according to FIG. 1 with a pushed out infeed table 10 and the feeding unit 50 with the flat material part 5 lowered onto the infeed table 10. After the flat material part 5 has been held on the suction cups 51 by vacuum application and returned to the position of FIG. 5, the application of a negative pressure/vacuum to represent FIG. 6 has been reduced via a valve control (lower negative pressure) in such a way that the dead weight of the flat material part 5 allowed it to be lowered onto the feed table 10. In the side view of FIG. 6, the flat material part 5 forms an acute angle in the range between 70 and 85 degrees with the inward facing part of the feed table 10.

The reference mark 54 shows a reinforcing profile, which is arranged in direction 7 depending on the force required on the processing tool.

FIG. 7 shows a schematic side view of the processing machine 1 according to FIG. 1 with a pushed out infeed table 10 and the upper turning unit 50 with released flat material part 5 sliding on the infeed table 10; just before the flat material part 5 comes to rest fully on the infeed table 10. This movement is ensured by the fact that when the flat material part 5 is picked up, it has the said slightly acute angle with the feed table towards the inside of the processing machine 1, which now changes to 0 degrees (=complete resting) in FIG. 7 when the angle is below 30 degrees.

Figure 8:
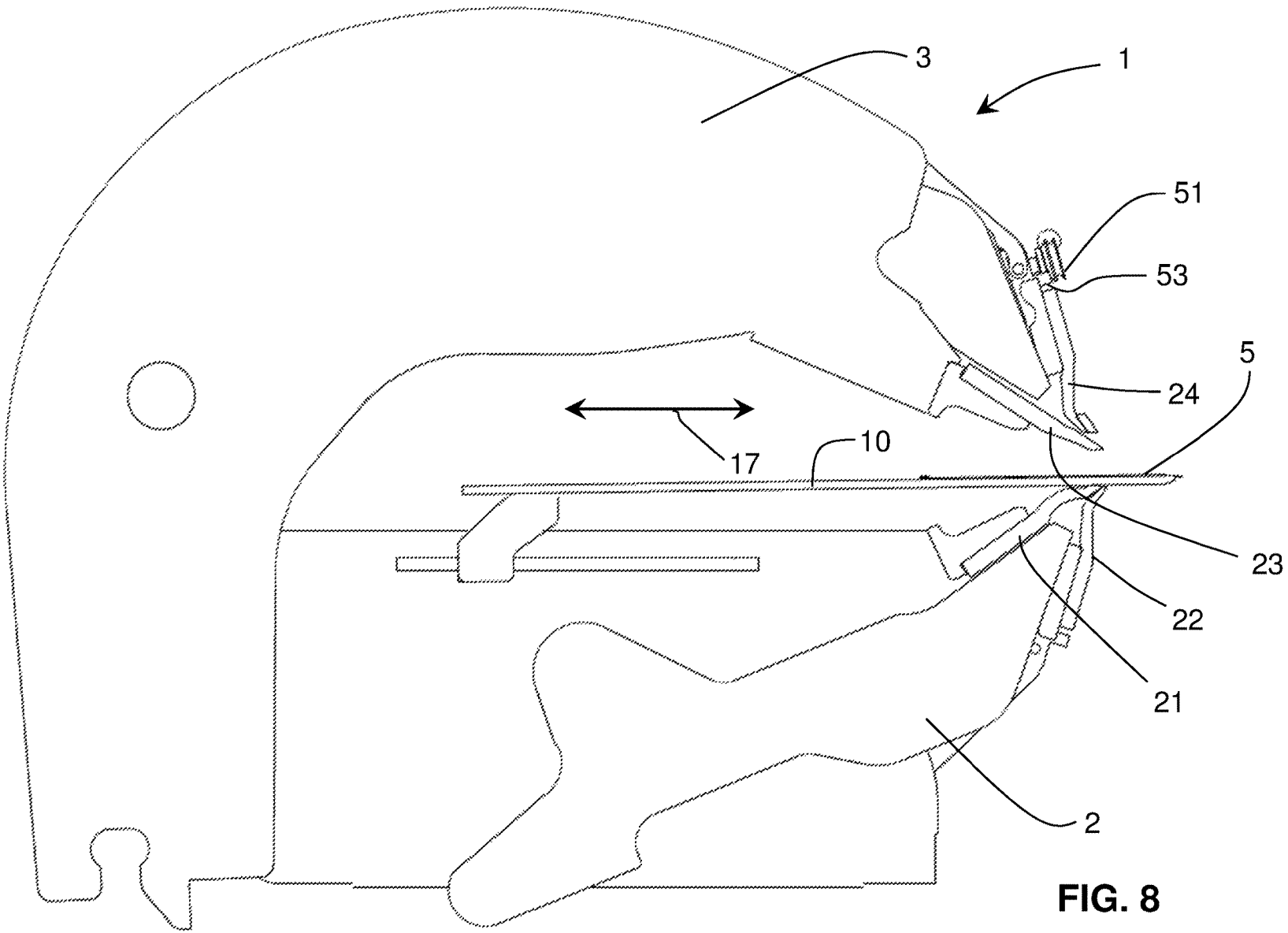
FIG. 8 shows a schematic side view of the processing machine according to FIG. 1 with a partially retracted infeed table and the flat material part now turned over in comparison to its position in FIG. 2.

FIG. 8 shows a schematic side view of the processing machine 1 according to FIG. 1 with a partially retracted feed table 10 and the flat material part 5 now turned opposite as shown in FIG. 2. Thus a complete turn has been achieved via the sequence from FIG. 2 to FIG. 8. If in FIG. 6 the feed table is drawn in before the flat material part 5 is released by the suction cups, the flat material part 5 can alternatively also be lowered directly to the ground or to a carriage arranged in front of the processing machine 1.

Figure 9:
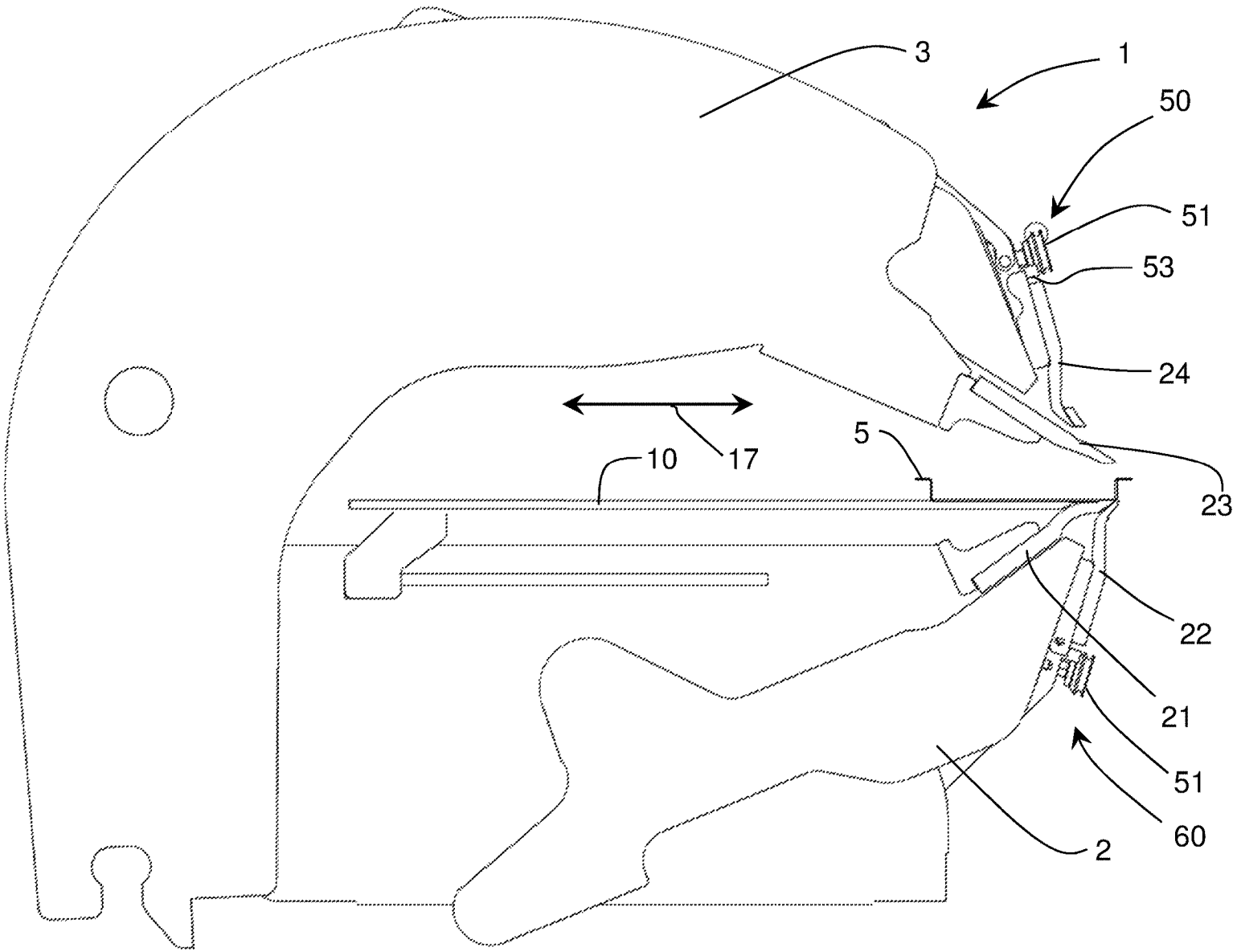
FIG. 9 shows a schematic side view of here essential parts of a processing machine with an infeed table and an upper and a lower support unit, each in a rest position.

FIG. 9 to FIG. 12 show in sequence the sequence of movements when using the further support unit, which is designed here as the lower turning unit 60. FIG. 9 shows a schematic side view of the main parts of a processing machine 1 with an infeed table 10 and the upper and lower turning units 50 and 60 in a rest position. The upper part 3 is slightly opened opposite and in view of the lower part 2. The flat material part 5 is already machined at both side ends and has an "S" shape in the cross-section shown. An upper turning unit 50 and a lower turning unit 60 are shown, whereby only the lower turning unit 60 will come into action here in sequence. This lower turning unit 60 is also equipped with corresponding suction cups 51, which are mounted on a frame part 53, which is firmly connected to the lower machining tool 22.

Figure 10:
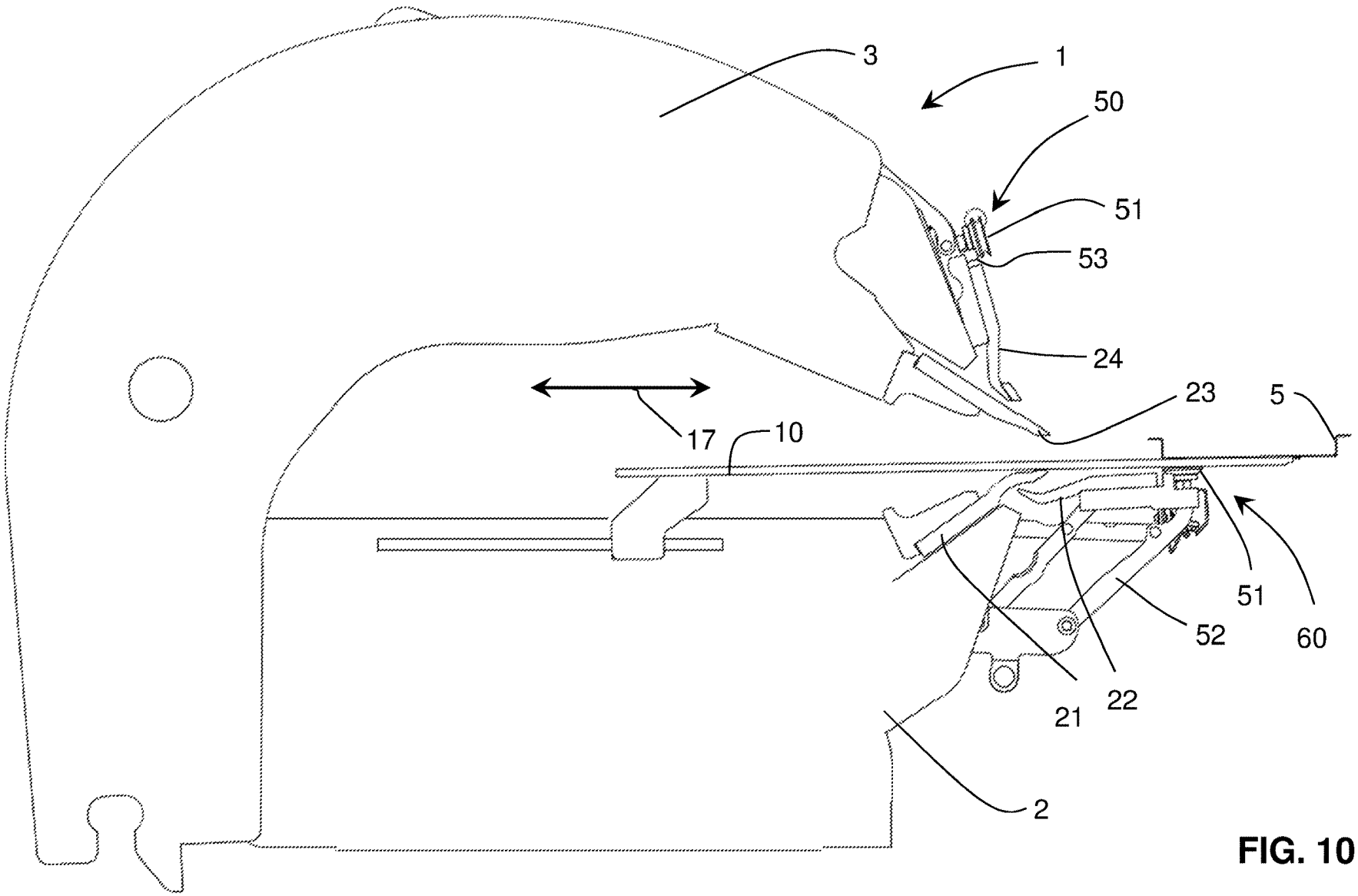
FIG. 10 shows a schematic side view of the processing machine according to FIG. 9 with a pushed out infeed table and the lower loading unit on the flat material part in a receiving position.

FIG. 10 shows a schematic side view of the processing machine 1 according to FIG. 9 with a pushed out infeed table 10, on which the sheet metal 5 already processed here lies. The upper loading and turning unit 50 is in a resting position and will remain so even after the sheet 5 has been turned and during the turning process. The turning process will be carried out here by a lower loading and turning unit 60, which is attached to the lower processing tool 22. The lower processing tool 22 is swivelled in the same way as for a folding operation, except that the upper part 3 of processing machine 1 is slightly open in relation to the lower part 2. This opening only needs to be slightly open so that the processed flat material part 5 can be pushed safely through between the beams 21 and 23 on the feed table 10. In the embodiment shown, the lower processing tool 22 with the parallelogram mechanism 52 on the holder 53 is swivelled outside the lower part 2 so that the suction cup 51 shown (from a series of suction cups 51 arranged parallel to the processing tool 22 in direction 7) is applied to the flat material part 5 from below so that the flat material part 5 adheres to the suction cups 51 by means of a downstream suction of air located inside the suction cup 51. In the side view of FIG. 10, the part of the suction cup 51 which is in contact with the flat material part 5 is covered by the feed table 10. At least here the feed table 10 is not a continuous surface but has slots at least at the locations of the suction cups 51 in the direction of the double arrow 17 through which it can be placed against the flat material part 5 from below and through which the feed table 10 can be retracted and extended in the direction of this double arrow 17.

Figure 11:
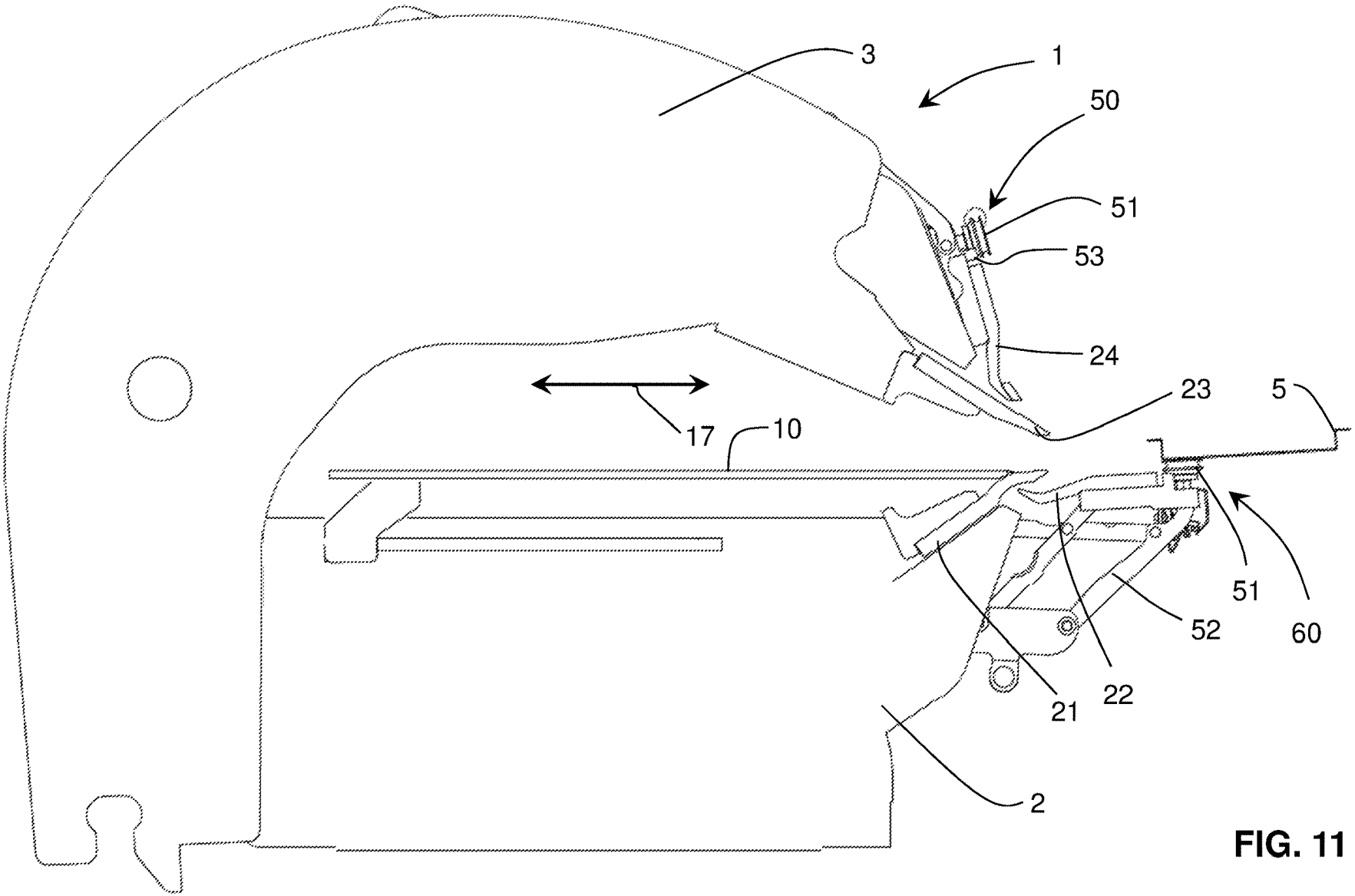
FIG. 11 shows a schematic side view of the processing machine according to FIG. 9 with a retracted infeed table and the support unit 60 with the flat material part picked up and supported by it.

FIG. 11 shows a schematic side view of the processing machine 1 according to FIG. 9 with a retracted infeed table 10 and the loading and turning unit 60 with the flat material part 5 picked up and carried by it before the loading and turning unit 60 returns to its rest position. The end position of the parallelogram mechanism 52 shown in FIG. 11 goes beyond the folding position of the lower processing tool 22 and also leads beyond the horizontal as alignment of the front end face of the suction cups 51. For this reason, the free edge of flat material part 5 facing away from processing machine 1 (as far as the main alignment of flat material part 5 is concerned) is positioned higher than the base of processing machine 1 in relation to the end of flat material part 5 which is near the suction cups here.

Figure 12:
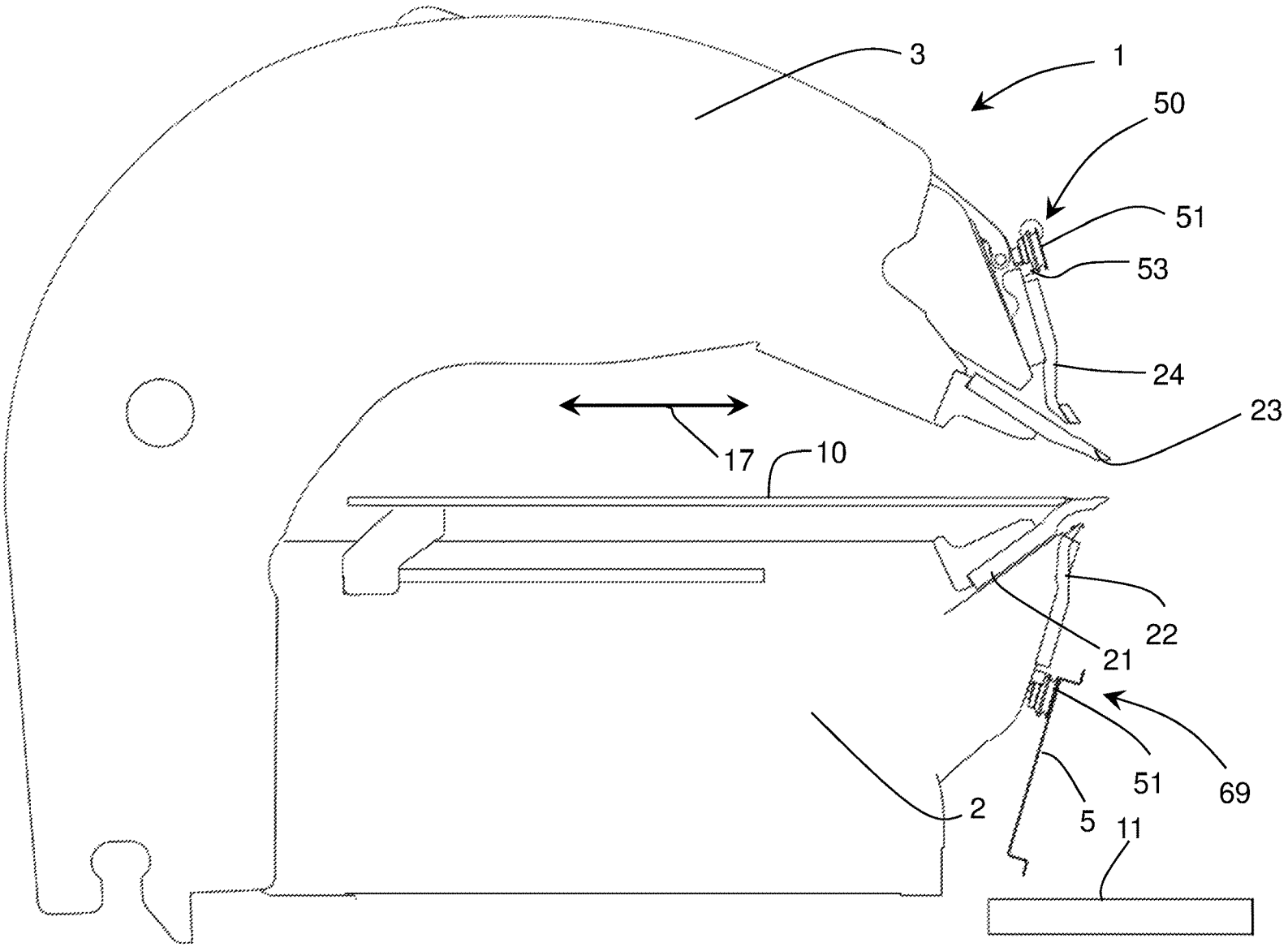
FIG. 12 shows a schematic side view of the processing machine according to FIG. 9 with the support unit in rest position but activated suction cups with the flat material part still held above a support.

FIG. 12 shows a schematic side view of the processing machine 1 according to FIG. 9 with the lower turning unit 60 swivelled out beforehand in rest position but with activated suction cups 51 with the flat material part 5 still held with it above a support 11. Starting from FIG. 11, the lower turning unit 60 is swivelled back so that the lower retaining beam 21 forms the lower edge opposite the upper retaining beam 23 and the flat material part 5 held by the suction cups 51 is swivelled downwards.

It is possible, but not shown in FIG. 12, that the plane defined by the main plane of the flat material part 5 is aligned similar to the flat material part 5 in FIG. 6. If the suction cups are then no longer held under negative pressure, the flat material part 5 falls onto its back and the two "S" folds projecting upwards remain at the top. The flat material part 5 then falls onto the tray 11 without having been turned over before. The advantage then, especially with very long sheets that extend over six or eight sections in transverse direction 7, is that the flat material part 5 only falls from a low height, making the risk of accidents and damage to the component less likely.

When the suction cups 51 are released only in the position shown in FIG. 12, the lower turning unit 60 acts as a turning unit and turns the flat material part 5 in relation to its position in e.g. FIG. 9 and then places it on the tray 11.

Analogous to the embodiment according to FIG. 6, the lower placement unit can also be designed as a feeding unit, if in the position of FIG. 12 the (then still unprocessed) flat material part 5 is pressed against the row of suction cups and then the suction cups 51 with their parallelogram mechanism are moved backwards, so to speak, to FIG. 11, in order to then, after pushing the infeed table 12 underneath, first correctly position the flat material part for the folding processes described above.

The arrangement of the lower and upper turning units 50 and 60 fixed to the associated bending tools 24 or 22 or to an axis parallel to their pivot axis, which is also an axis parallel to the axis of movement of the upper part 3 (and provided that the lower part 2 can be pivoted) or parallel to the axis of movement of the lower part 3, allows the flat material part to be turned more quickly and safely or the flat material part to be conveyed more quickly out of the bending machine. As these units operate outside the upper part 3 and lower part 2, it does not need to be opened as far, which saves further time. By arranging the support beams and processing tools 21, 22 and 23, 24 one on top of the other, which is not necessary for the initial advantages of this support unit 50 or 60, the angular ratios for the turning units 50 and 60 with the easy achievement of an angle of more than 90 degrees for effective turning are easier and can be achieved by using the parallelogram mechanism 52, which is already available for bending anyway, which means one axis of movement less.

Figure 13:
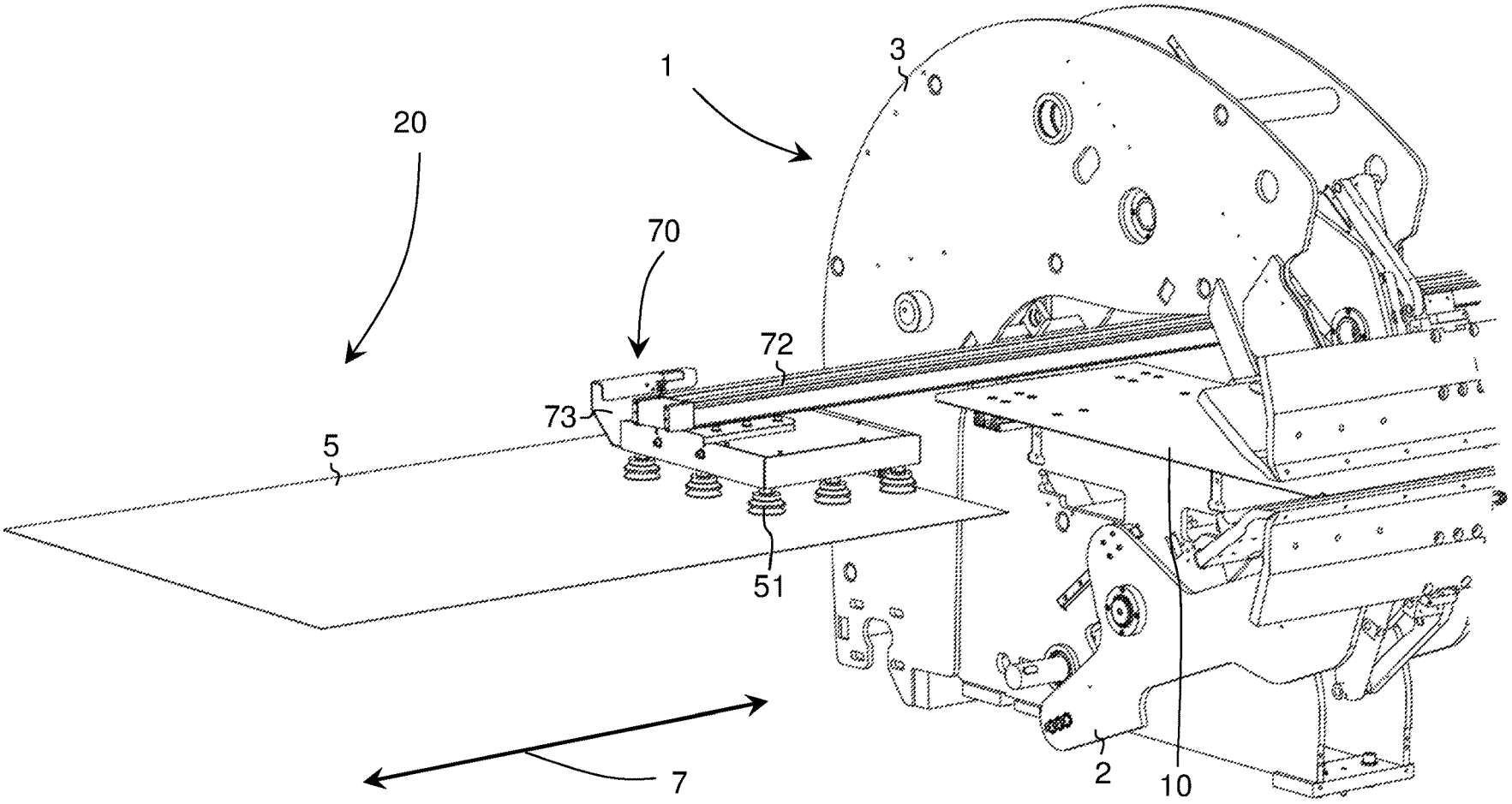
FIG. 13 shows a perspective view with essential parts of a processing machine according to a design example of the invention.

FIG. 13 shows a perspective view with essential parts of a processing machine 1 according to a design example of the invention. The infeed table 10 is in a retracted position between the upper part 3 and the lower part 2, of which only one section is shown here. This shown section is the foremost section in front of a set-up area 20, which has a transfer table 80 not shown here. Transverse between the upper part 3 and the lower part 2 runs a support unit as a side insertion unit 70, which has a side insertion rail 72, under which a frame component 73 is arranged so that it can be moved in the direction of 7. A large number of suction cups 51, here nine, are arranged on the frame component 73 in a 3×3 matrix, with which a flat material part 5 can be picked up laterally outside the processing machine 1 by the aforementioned set-up table 80. This has already been done here. The suction cups 51 correspond to the suction cups of the other design example with a corresponding, advantageously hydraulic control of valves and a permanently operated vacuum source.

Figure 19:
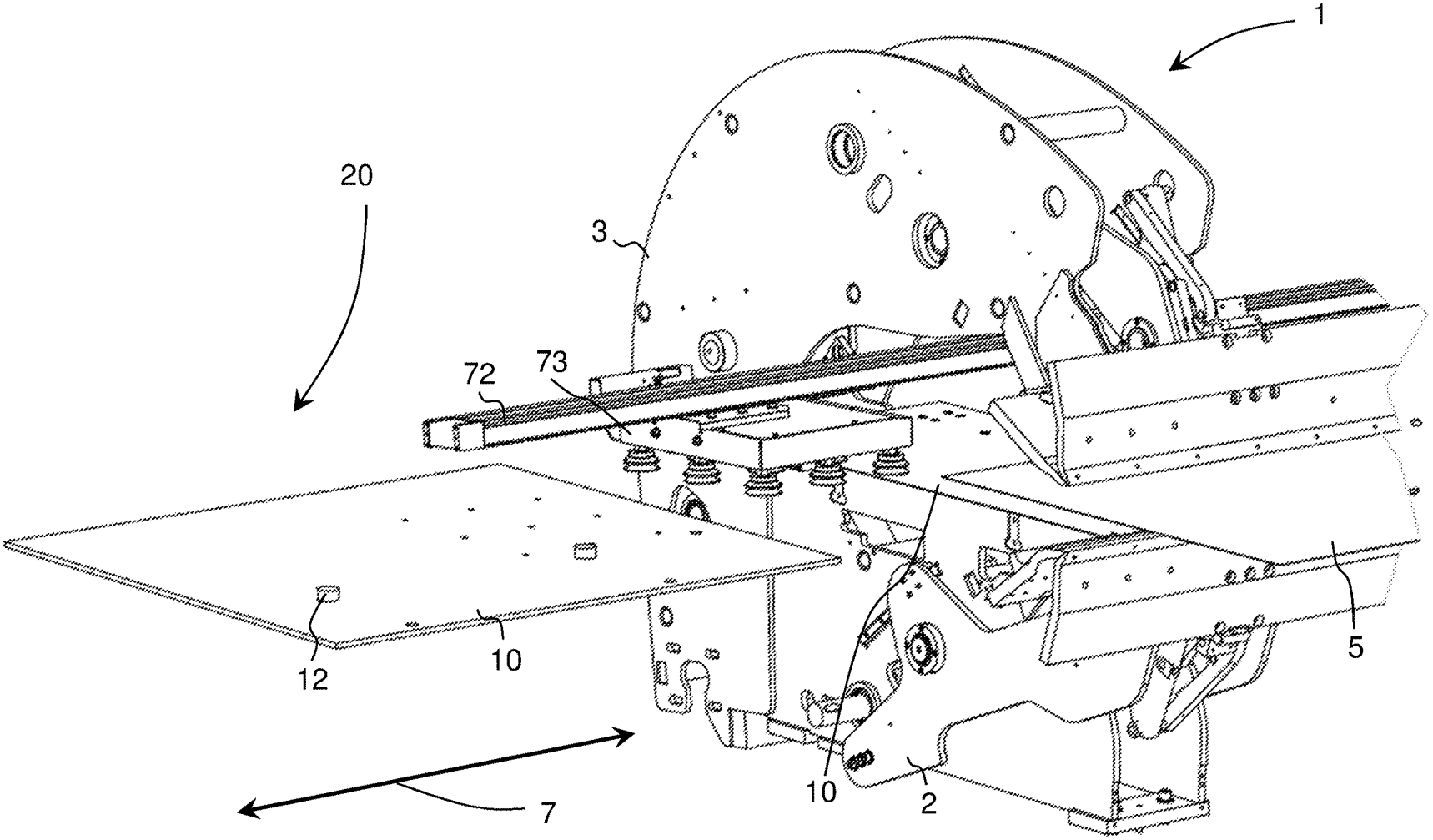
FIG. 19 shows a perspective view of the situation of the processing machine according to FIG. 18 while the flat material part is being processed with the side shift unit in a parking position.
Figure 21:
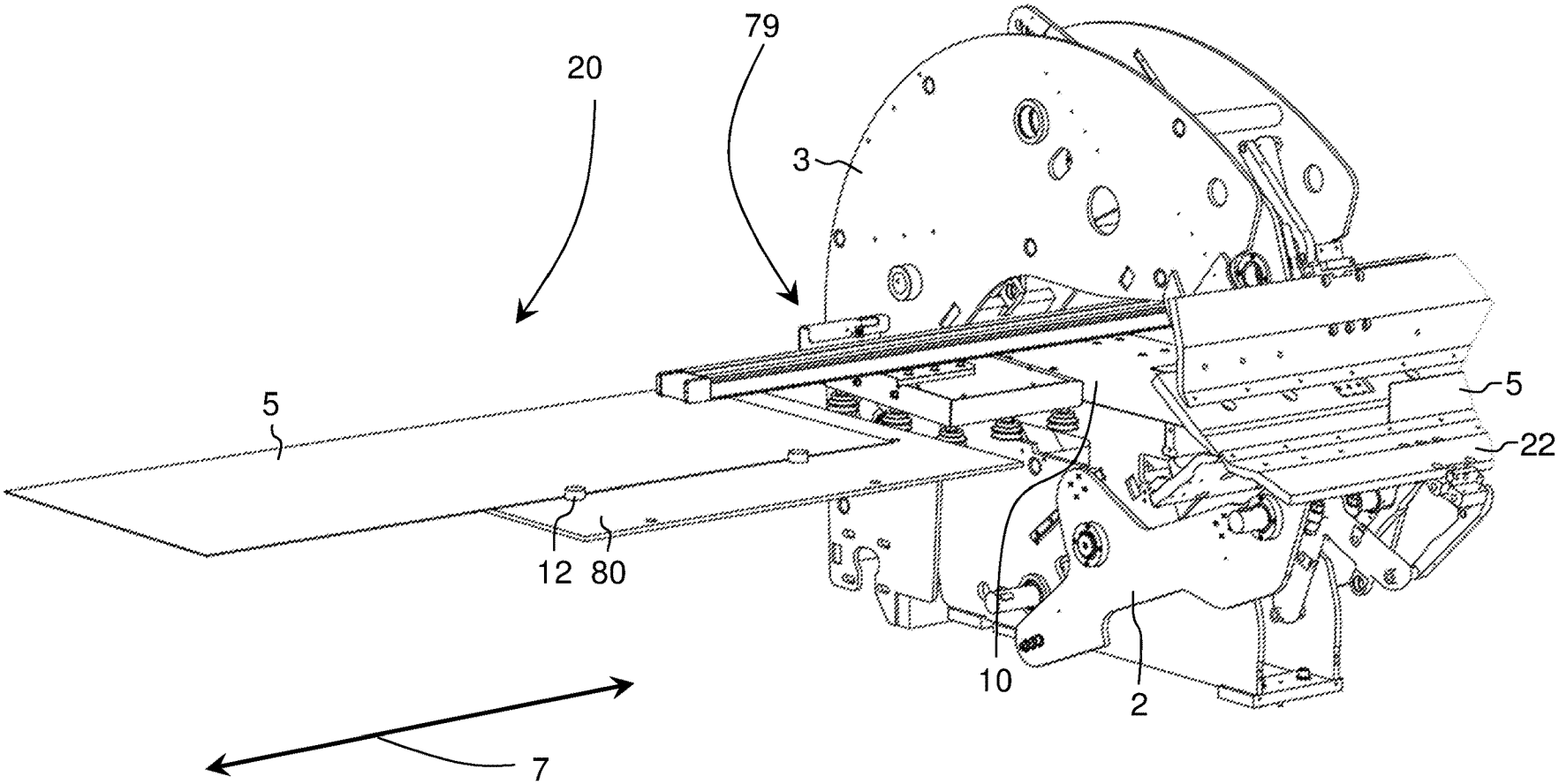
FIG. 21 shows a perspective view of the processing machine according to FIG. 1 during a folding operation of a first flat material part.

The frame component 73 and thus the side insertion rail 72 is firmly connected to the upper part 3. This leads in particular to a saving of an axis to be moved, since in this way a lifting of the flat material part 5 by the suction cups 51 of the side insertion unit 70 can be achieved simply by a slight opening (and thus tilting of the rail 72. To make it easy for the user to reach the correct position of the flat material part 5 for insertion into the processing machine 1, a fixed transfer table 80 with stops 12 is provided. These stops are shown in FIGS. 1, 19 and 21 arranged only to the front. Lateral stops are not necessary as the position of the flat material part 5 in the direction of the arrow 7 is not critical because the cutting length of the bending machine 1 always extends far beyond the length of the flat material part 5.

Figure 14:
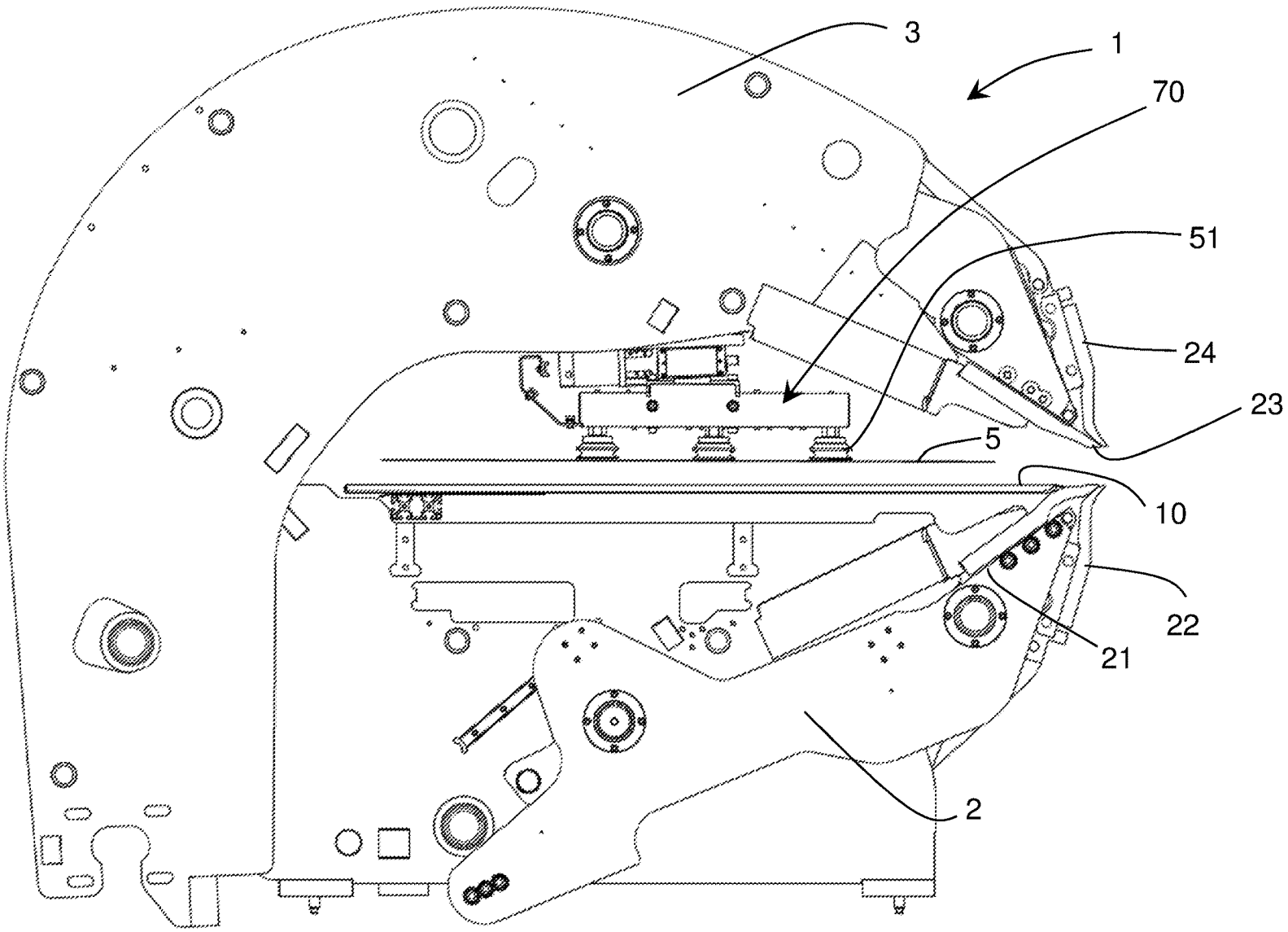
FIG. 14 shows a schematic side view of the processing machine according to FIG. 13 with the support unit in the pick-up position with activated suction cups with the flat material part held above.
Figure 15:
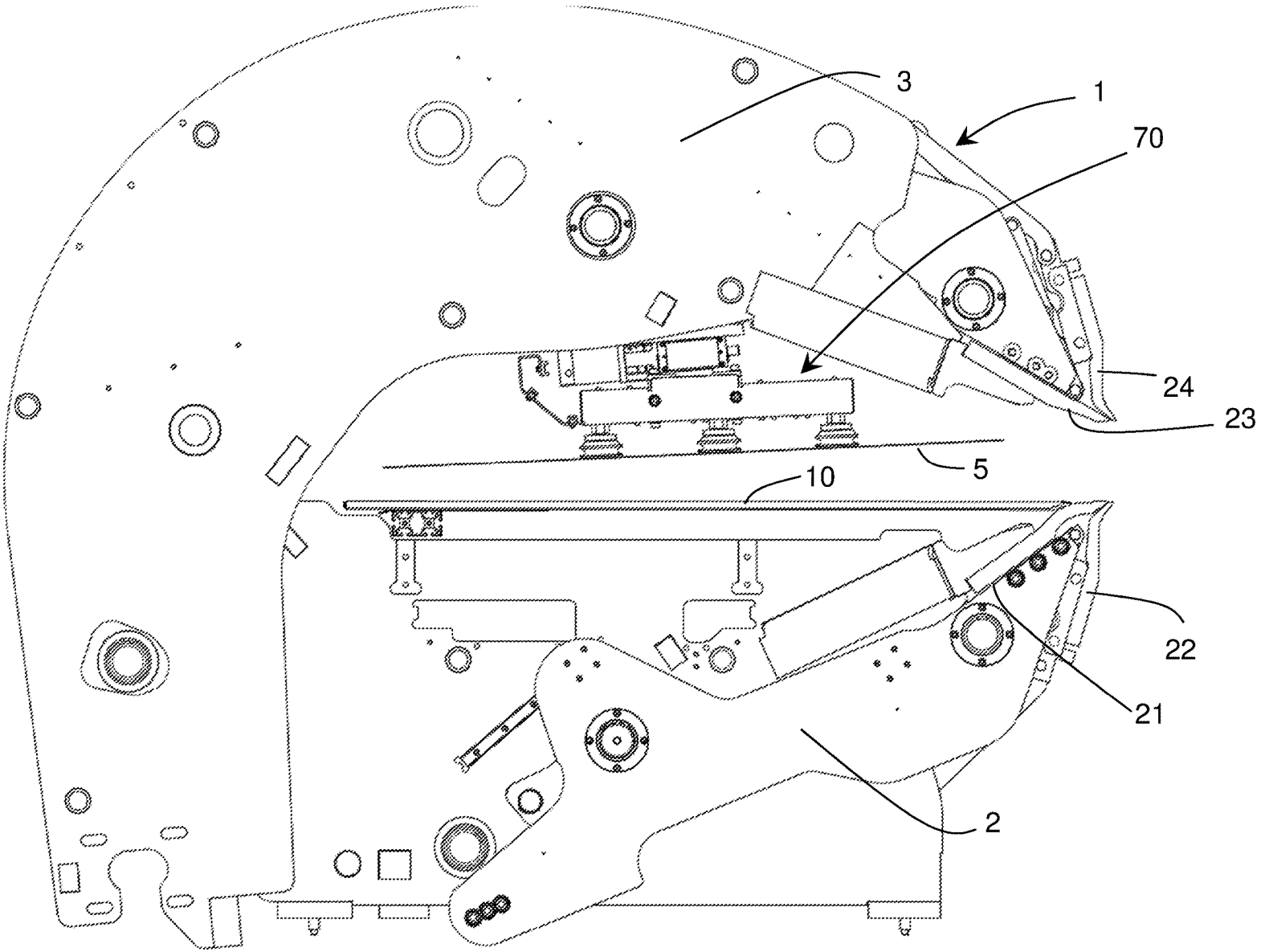
FIG. 15 shows a schematic side view of the processing machine according to FIG. 13 with the support unit in the insertion movement of the picked up flat material part in time after the representation of FIG. 14.

FIG. 14 shows a schematic side view of processing machine 1 according to FIG. 13 with the side insertion unit 70 in the pick-up position with activated nine suction cups 51 with picked-up flat material part 5. FIG. 15 shows a schematic side view of processing machine 1 according to FIG. 13 with the support unit in the insertion movement of the picked-up flat material part 5, whereby the upper part 3 is slightly open so that the flat material part 5 is slightly inclined in relation to the support table 10. FIG. 15 shows the insertion movement, so that it shows a state after FIG. 14. This can also be seen in FIG. 16, which shows a perspective view of the situation of FIG. 15 with the retracting side insertion unit 70, whereby the suction cups 51 have moved the suctioned flat material part 5 in the direction of the double arrow 7 (here to the right) and continue to move it.

Figure 16:
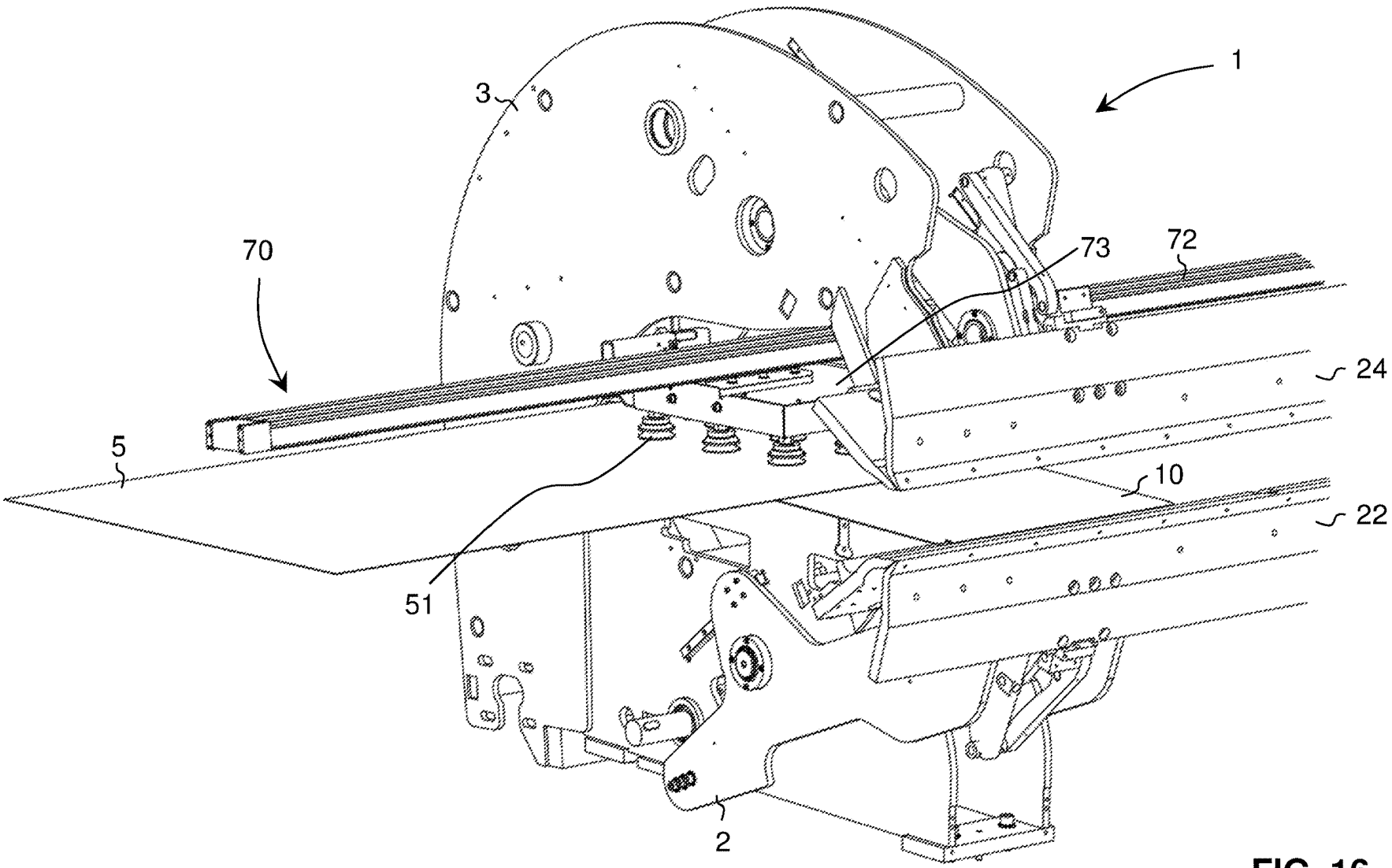

When the flat material part 5 is picked up in FIG. 14, the upper part 3 of the processing machine 1 is slightly closed, i.e. towards the lower beam 21, but not for clamping, but for docking the suction cups 51 on the flat material part 5. It is thus clear, and this is shown later in FIG. 20, that the transfer table 80 is arranged parallel to the infeed table 10 but higher with respect to the horizontal. After the flat material part 5 has been sucked in as shown in FIG. 14, the upper part is slightly opened, whereby the insertion rail is raised and tilted about the same axis of rotation so that the flat material part 5 picked up is lifted off the transfer table 80 and then moved by the frame component 73 along the side insertion rail 72 in the direction of insertion of the double arrow 7 until, far as shown in FIG. 16, the entire flat material part 5 is inserted into the processing machine 1 until it is positioned between beams 21 and 22.

Figure 17:
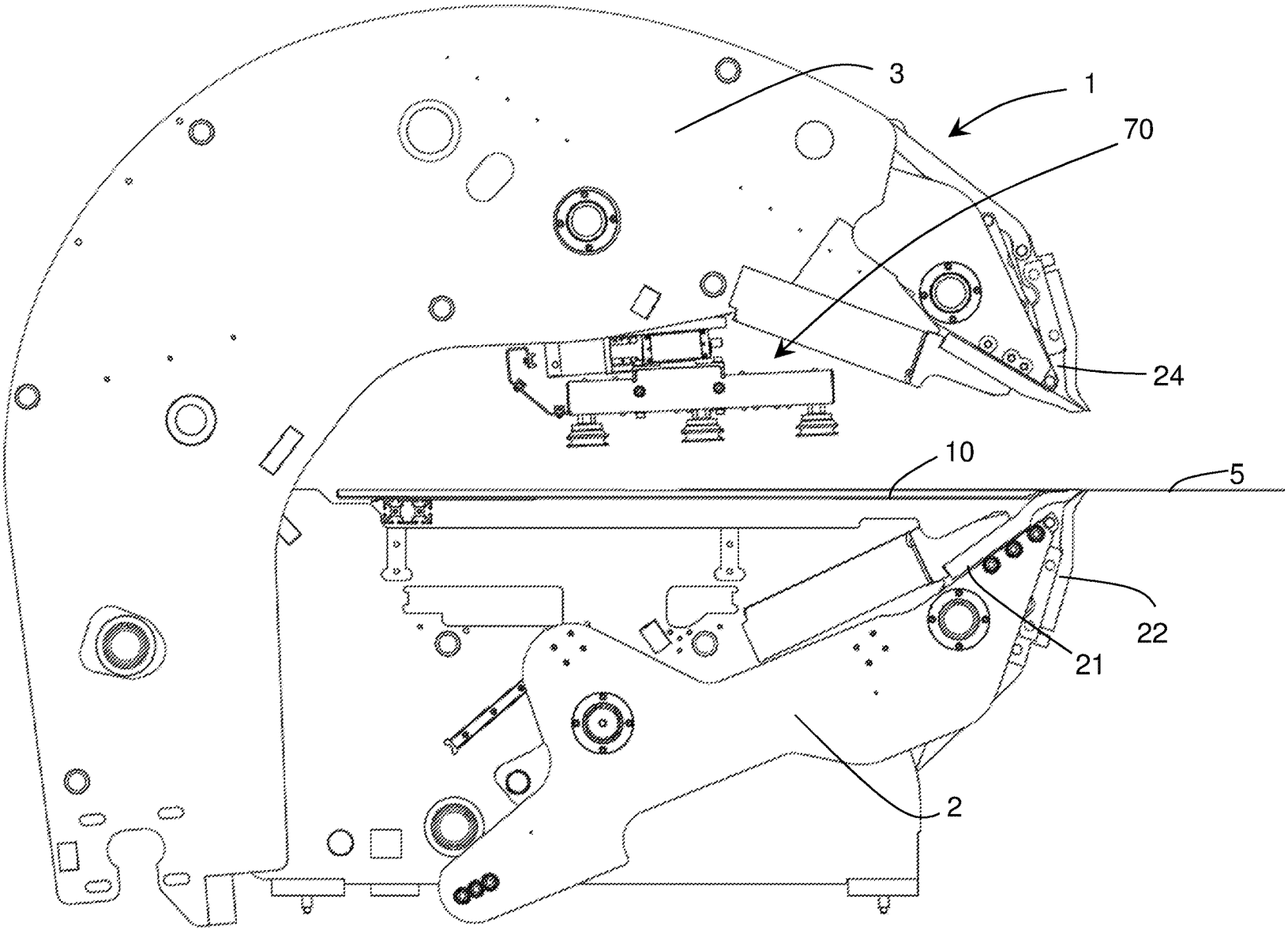
FIG. 17 shows a schematic side view of the processing machine according to FIG. 13 with the support unit after releasing the suction cups with the flat material part lowered, whereby the latter protrudes from the front of the machine.
Figure 18:
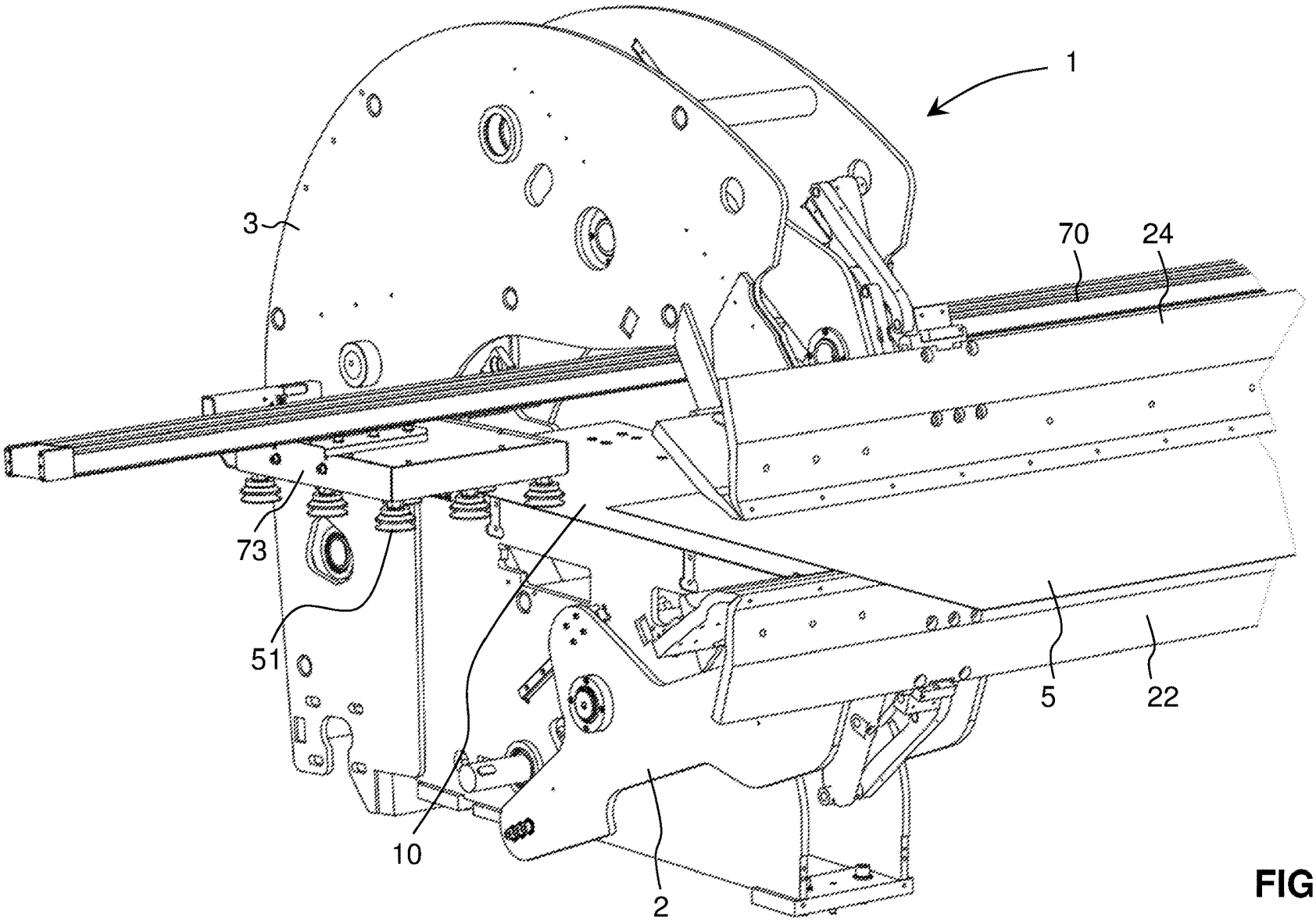
FIG. 18 shows a perspective view of the situation of the processing machine according to FIG. 13 after the frame component has been moved back.
Figure 20:
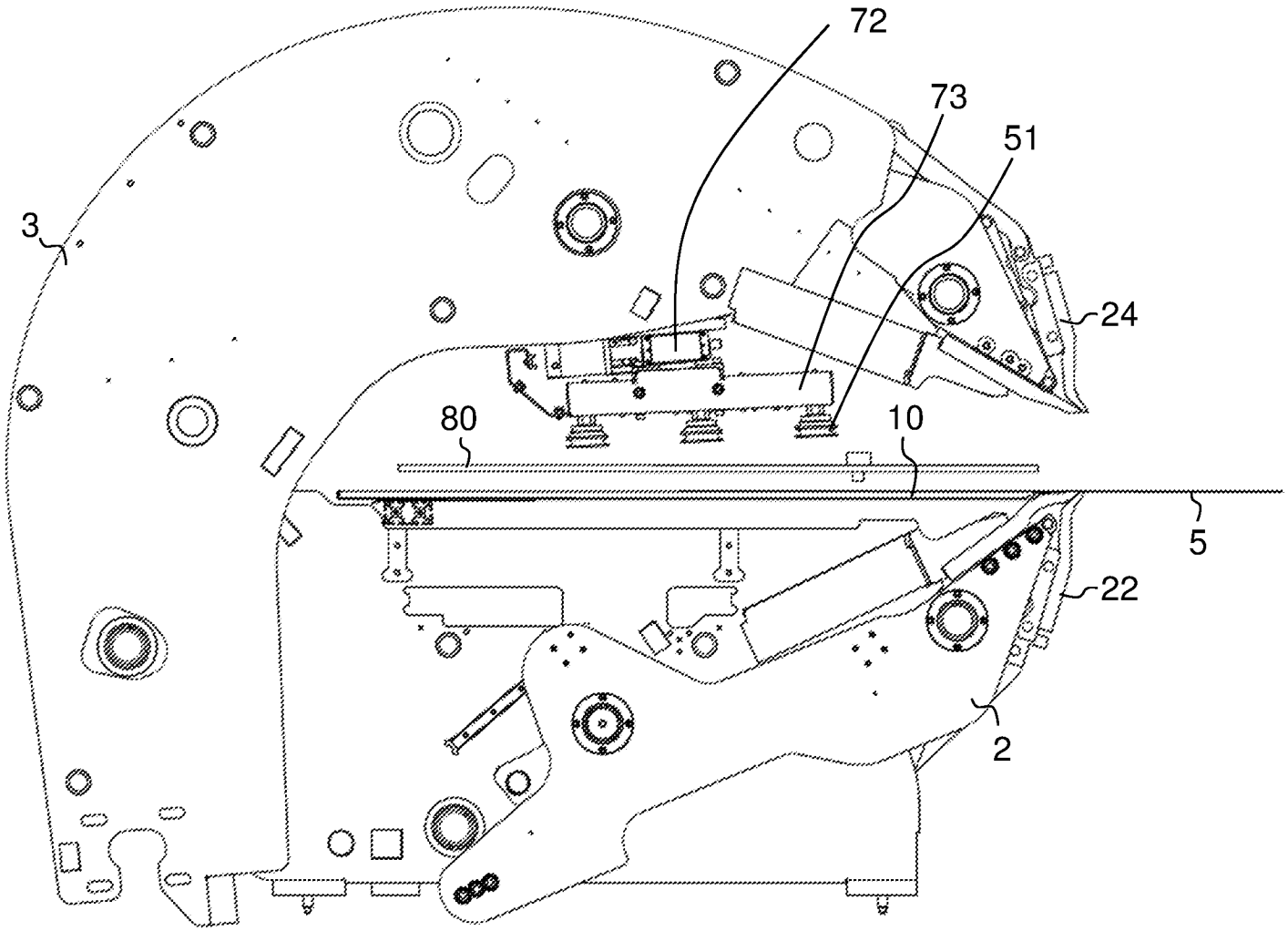
FIG. 20 shows a schematic side view of the processing machine according to FIG. 19.

FIG. 17 shows a schematic side view of the processing machine 1 as shown in FIG. 13 with the side insertion unit 70 after releasing the suction cups 51 with the flat material part 5 lowered, whereby the latter protrudes from the front of machine 1. For this purpose FIG. 18 shows a perspective view of the situation of the processing machine 1 chronologically according to FIG. 17, whereby the frame component 73 on the side insertion rail 72 of the side insertion unit 70 has been pulled back laterally again, while the sheet metal between the beams 22, 24 protrudes from the front of machine 1. FIG. 20 shows a schematic side view of the processing machine 1 according to FIG. 19.

These FIGS. 17 to 20 show that after releasing the flat material part 5, the flat material part 5 is pushed forward in an accurately positioned manner without using the feed table 10 by depth stops not shown here, which are located between segments of the feed table 10 divided in the direction of the double arrow, in order to then allow folding of the flat material part 5. To do this, frame component 73 is moved out to the side as shown in FIG. 18. FIG. 19 shows the position of the frame component 73 laterally next to the front section of processing machine 1, but in the direction of the double arrow 7 behind the transfer table 80, i.e. in a free space between the latter and the section of processing machine 1, so that the frame component 73 can move freely when the upper part 3 is lowered to a clamping position without being hindered by the transfer table 80 or a next flat material part 5 already placed back on it. This simultaneously addresses the time-saving simultaneous reloading of machine 1 on the transfer table 80 while the processing steps of clamping and folding are still in progress.

Figure 22:
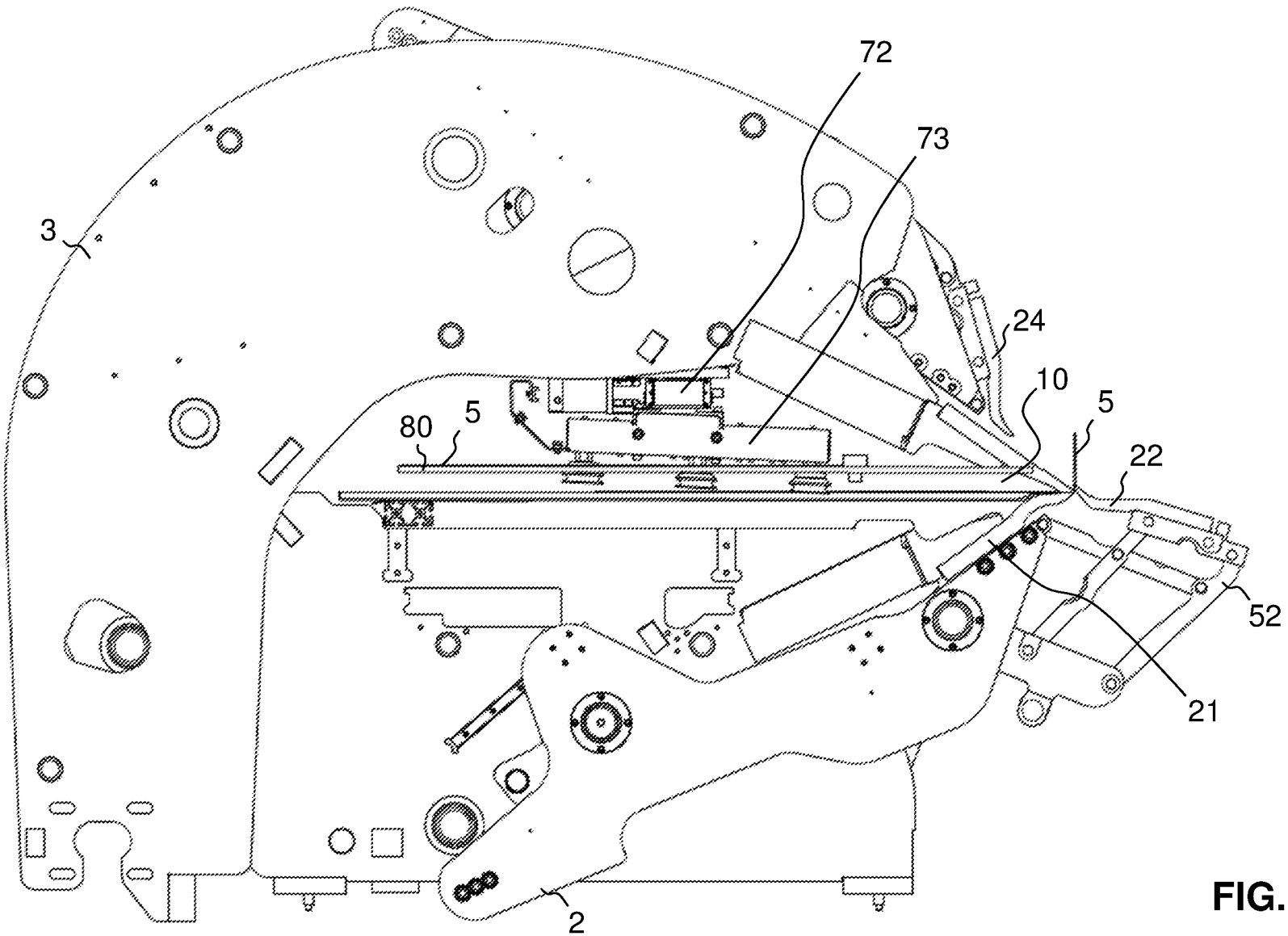
FIG. 22 shows a schematic side view of the processing machine according to FIG. 21 with the support unit after releasing the suction cups with the flat material part lowered, which is bent over.

FIG. 21 shows a perspective view of machine 1 during a folding process of a first flat material part 5, whereby the side insertion unit 70 as a loading unit is in the parking position and a second flat material part has been placed on the transfer table 80 and pushed against the stops 12; and FIG. 22 shows a schematic side view of the processing machine according to FIG. 21 with the side insertion unit 70 in the parking position, with the two flat members 5, one which is bent over in its front portion and the other which lies on the transfer table 80.

The invention claimed is:

1. A processing machine for flat material parts comprising an upper machine frame part and a lower machine frame part, a lower beam, an upper beam, at least one processing tool associated with the lower beam and held in the lower machine part or at least one processing tool associated with the upper beam and held in the upper machine part, an infeed table on which the flat material part to be processed can be placed for positioning in the processing machine, a placement unit for predetermined positioning of the flat material part on the infeed table, and a controller for controlling a processing sequence with the at least one processing tool and a movement of the placement unit and a movement of the infeed table, wherein the infeed table can be moved in an extension direction from a parked position to a second position and back again, and wherein a side insertion unit is provided which has a side insertion rail which is fixedly connected to the upper machine frame part and under which a frame component is arranged to be movable in the direction of a processing edge of the flat material part, wherein a plurality of first suction cups are mounted on the frame component with which the flat material part can be received and positioned, wherein a transfer table is arranged at the side of the processing machine in a parallel plane and higher than a plane predetermined by the infeed table, so that the plurality of first suction cups mounted on the frame component can be moved transversely to the at least one processing tool associated to the upper or lower beam for a feed movement of the flat material part in the direction of the processing edge of the flat material part.

2. The processing machine according to claim 1, wherein the placement unit is arranged in a space between the transfer table and the infeed table as a parking space.

3. The processing machine according to claim 1, further comprising an upper turning unit and/or a lower turning unit for predetermined positioning of the flat material part on the infeed table, wherein the upper turning unit and/or the lower turning unit has a plurality of second suction cups with which the flat material part can be received and positioned, wherein the upper turning unit and/or the lower turning unit is mounted on the axis of movement associated with the at least one processing tool for a pivoting movement in the same direction.

4. The processing machine according to claim 3, wherein the plurality of second suction cups form an acute angle with the infeed table.

5. The processing machine according to claim 4, wherein the infeed table can be moved out between the lower beam and the upper beam in order to receive a turned flat material part after the second suction cups have been released.

6. The processing machine according to claim 1, wherein an upper turning unit and a lower turning unit are provided, wherein the upper turning unit is associated as a loading and turning unit with the upper processing tool and wherein the lower turning unit is associated as a loading and turning unit with the lower processing tool.

* * * * *